US007815259B2

(12) United States Patent
Fookes et al.

(10) Patent No.: US 7,815,259 B2
(45) Date of Patent: Oct. 19, 2010

(54) ARM ASSEMBLY FOR A CHAIR

(75) Inventors: Tim Fookes, Hudsonville, MI (US); Tracy Cook, Douglas, MI (US); Keith Shoemaker, Holland, MI (US); Brian Gessler, Hudsonville, MI (US); Rick Roels, Zeeland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 12/384,253

(22) Filed: Apr. 2, 2009

(65) Prior Publication Data

US 2009/0189428 A1 Jul. 30, 2009

Related U.S. Application Data

(60) Division of application No. 11/598,165, filed on Nov. 10, 2006, now Pat. No. 7,533,939, which is a continuation of application No. PCT/US2006/007821, filed on Mar. 1, 2006.

(60) Provisional application No. 60/657,632, filed on Mar. 1, 2005.

(51) Int. Cl.
*B60N 2/46* (2006.01)

(52) U.S. Cl. ..... 297/411.35; 297/411.36; 297/411.37; 297/411.38; 297/411.33

(58) Field of Classification Search ..... 297/411.35–411.38, 411.33
See application file for complete search history.

(56) References Cited

U.S. PATENT DOCUMENTS

| | | | | |
|---|---|---|---|---|
| 5,407,249 | A | 4/1995 | Bonutti | |
| 5,484,187 | A | 1/1996 | Doerner et al. | |
| 5,590,934 | A | 1/1997 | Gibbs | |
| 5,620,233 | A | 4/1997 | Corwin | |
| 5,641,203 | A | 6/1997 | Van De Riet et al. | |
| 5,647,638 | A | 7/1997 | Ritt et al. | |
| 5,651,586 | A * | 7/1997 | Groth | 297/411.37 |
| 5,667,277 | A | 9/1997 | Van De Riet | |
| 5,749,628 | A | 5/1998 | Synder et al. | |
| 5,769,497 | A | 6/1998 | Tsai | |
| 5,829,839 | A | 11/1998 | Wilkerson | |
| 5,853,223 | A | 12/1998 | Ritt et al. | |
| 5,876,097 | A | 3/1999 | Cao | |

(Continued)

FOREIGN PATENT DOCUMENTS

DE 299 01 666 U1 3/2000

(Continued)

OTHER PUBLICATIONS

International Search Report mailed Dec. 20, 2006.

*Primary Examiner*—Laurie K Cranmer
(74) *Attorney, Agent, or Firm*—Flynn, Thiel, Boutell & Tanis, P.C.

(57) ABSTRACT

An office chair is provided with includes a chair arm assembly on each opposite side thereof for supporting the arms of a user. The arm assemblies each include a latching assembly to permit adjustment of the height of an arm cap thereof while maintaining the arm cap at a selected elevation. The latch assembly is engageable with an inner liner provided within a support post. Further, the armrest assembly has a plurality of interconnected and relatively movable plates which permit adjustment of the angular orientation of the arm cap along with adjustment of the arm cap in the front-to-back direction and the side-to-side direction.

17 Claims, 21 Drawing Sheets

U.S. PATENT DOCUMENTS

| | | | | | |
|---|---|---|---|---|---|
| 5,884,976 | A | | 3/1999 | Breen et al. | |
| 5,895,095 | A | | 4/1999 | Chen | |
| 5,927,811 | A | | 7/1999 | Tseng | |
| 5,971,484 | A | * | 10/1999 | Lamart et al. | 297/411.37 |
| 6,017,091 | A | * | 1/2000 | Cao | 297/411.37 |
| 6,022,079 | A | | 2/2000 | Bergsten et al. | |
| 6,053,579 | A | | 4/2000 | Nelson et al. | |
| 6,074,012 | A | | 6/2000 | Wu | |
| 6,076,891 | A | | 6/2000 | Bernhardt | |
| 6,106,070 | A | | 8/2000 | Ritt et al. | |
| 6,139,107 | A | | 10/2000 | Lee | |
| 6,142,570 | A | | 11/2000 | Bergsten et al. | |
| 6,203,109 | B1 | | 3/2001 | Bergsten et al. | |
| 6,315,362 | B1 | | 11/2001 | Chuang | |
| 6,343,840 | B1 | | 2/2002 | Chuang | |
| 6,398,309 | B1 | | 6/2002 | Chen | |
| 6,419,323 | B1 | | 7/2002 | Chu et al. | |
| 6,460,932 | B1 | | 10/2002 | Kopish et al. | |
| 6,502,904 | B1 | | 1/2003 | Hansen | |
| 6,585,322 | B1 | | 7/2003 | Lai | |
| 6,733,080 | B2 | | 5/2004 | Stumpf et al. | |
| 6,799,803 | B1 | * | 10/2004 | Lee et al. | 297/411.35 |
| 6,948,774 | B2 | * | 9/2005 | Maier et al. | 297/411.31 |
| 6,948,775 | B2 | * | 9/2005 | Tsai | 297/411.37 |
| 7,249,802 | B2 | * | 7/2007 | Schmitz et al. | 297/452.31 |
| 2002/0036422 | A1 | | 3/2002 | Prince et al. | |
| 2002/0190561 | A1 | | 12/2002 | Phillips et al. | |
| 2003/0030317 | A1 | | 2/2003 | Chen | |
| 2003/0178882 | A1 | | 9/2003 | Schmitz et al. | |
| 2003/0214171 | A1 | | 11/2003 | Burwell et al. | |

FOREIGN PATENT DOCUMENTS

| | | | |
|---|---|---|---|
| EP | 0 958 765 | A2 | 11/1999 |

* cited by examiner

ARM ASSEMBLY FOR A CHAIR

CROSS REFERENCE TO RELATED APPLICATION

This application is a divisional of U.S. Ser. No. 11/598,165, filed Nov. 10, 2006, now U.S. Pat. No. 7,533,939 which is a continuation of PCT Application No. PCT/US06/07821, filed Mar. 1, 2006, which claims the benefit of U.S. Provisional Application No. 60/657,632, filed Mar. 1, 2005, which are incorporated herein by their entirety.

FIELD OF THE INVENTION

The invention relates to an improved arrangement of an arm assembly for an office chair, and more particularly, to an arm assembly wherein the elevation, angular, longitudinal and transverse positions of an arm cap are readily adjustable.

BACKGROUND OF THE INVENTION

Conventional office chairs are designed to provide significant levels of comfort and adjustability. Such chairs typically include a base which supports a tilt control assembly to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assemblies so that they may tilt rearwardly together in response to movements by the chair occupant and possibly to permit limited forward tilting of the seat and back. Further, such chairs typically permit the back to also move relative to the seat during such rearward tilting.

In addition to supporting the seat and back of the occupant, the chair also may include support assemblies that support the occupant's body at various locations thereof. One primary support assembly of this type is an arm assembly wherein an arm assembly is mounted on each opposite side of the seat so as to support the arms and specifically, the elbows and forearms of the occupant. Such arm assemblies project upwardly and include an upward facing armrest thereon which armrest defines a support surface to accommodate the occupant's arms.

However, one difficulty associated with the design of conventional office chairs is the fact that office workers have different physical characteristics and comfort preferences such that it is difficult to design a single chair configuration that satisfies the preferences of the different individuals who might purchase such a chair.

To accommodate these differences, it is known to provide arm assemblies which allow for adjustment of the height of the armrest as well as the relative location of the armrest relative to the seat assembly. An armrest therefore may be movable in its angular orientation as well as its position in the front-to-back direction as well as the side-to-side direction.

In view of the foregoing, it is an object of the invention to provide an improved arm rest assembly which allows ready configurability thereof while providing improved comfort with respect to the range and combination of motions which are permitted.

The invention relates to an arm assembly which not only is height adjustable but also permits adjustment of the armrest in the angular, front-to-back and sideward directions. This arm assembly includes a support post mounted to the base of the chair and preferably, the upright thereof so that the armrest moves in unison with the upright during tilting of the chair and maintains the arms in a proper orientation relative to the seat and back of the user when reclining.

To provide this height-adjustability, the arm assembly includes an armrest assembly having a vertically elongate column that projects downwardly and is slidably received within a tubular support post fixed to the chair frame. This support post includes an arrangement of plastic liner sections which fit within the tube and also define vertically spaced apart recesses that correspond to various elevations at which the armrest may be maintained.

To maintain the armrest at such elevations, a latch mechanism is provided which comprises a vertically movable lever disposed within a hollow interior of the armrest column. The latch assembly further includes a cassette assembly which snaps into the side of the column and has a spring-loaded, slidable latch that moves sidewardly into engagement with any of the various recesses located within the post liner. The cassette assembly also engages with the lever and prevents removal thereof.

The armrest provides three directions of movement in addition to height-adjustability. Specifically, the armrest includes a multi-layer plate arrangement wherein multiple layers of plates are stacked one above the other and are each movable horizontally in an associated direction.

More particularly, a first pivot plate is pivotally connected to the armrest column and is maintained in a selected angular position by a first detent. The detent defines multiple angular positions at which the armrest may be maintained while also permitting angular movement of the armrest when the stopping threshold or capacity of the detent is overcome as the occupant manually moves the arm cap at the top of the armrest.

The pivot detent preferably comprises a ring of elastomeric material wherein one sidewall of this ring includes a plurality of angularly spaced recesses that define the various angular positions of the armrest. Deflection of this detent wall therefore permits angular movement and defines the stop capacity of the detent.

Additionally, a second slide plate is mounted on top of the pivot plate and is slidable relative thereto in the front-to-rear direction. A slide detent is fitted within the slide plate wherein this slide detent is fixed to the pivot plate to fasten the slide plate to the pivot plate. The slide detent also selectively restrains the slide plate while also defining a stop threshold above which, the slide plate may be moved upon the user's manual application of a suitable force to the arm cap. The slide detent is formed somewhat similar to the pivot detent in that it is a ring of elastomeric material which is deformable. In this case, the slide detent has opposite sidewalls which deflect inwardly.

Furthermore, an upper transverse subcap plate is slidably supported on the intermediate slide plate through a retainer. The subcap plate is sidewardly or transversely slidable while the retainer carries a resiliently deflectable top detent that engages the subcap plate to maintain the subcap plate in a sidewardly adjusted position while defining a stopping threshold above which a force may be applied to the arm cap to permit sideward adjustment thereof.

With this arrangement, the arm cap may be readily adjusted vertically as well as horizontally.

Other objects and purposes of the invention, and variations thereof, will be apparent upon reading the following specification and inspecting the accompanying drawings.

Figure 2:
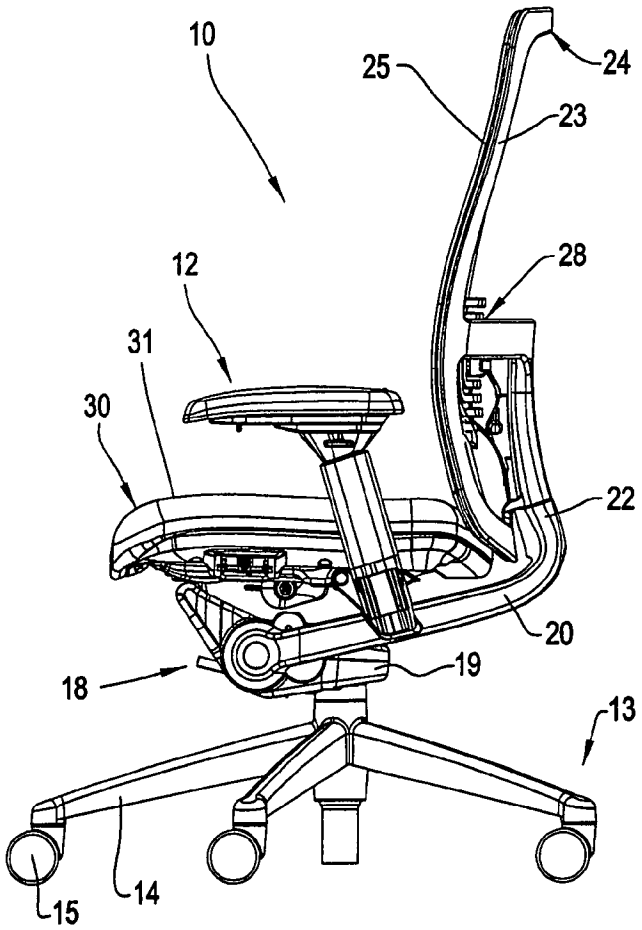
FIG. 2 is a side elevational view of the office chair.
Figure 1:
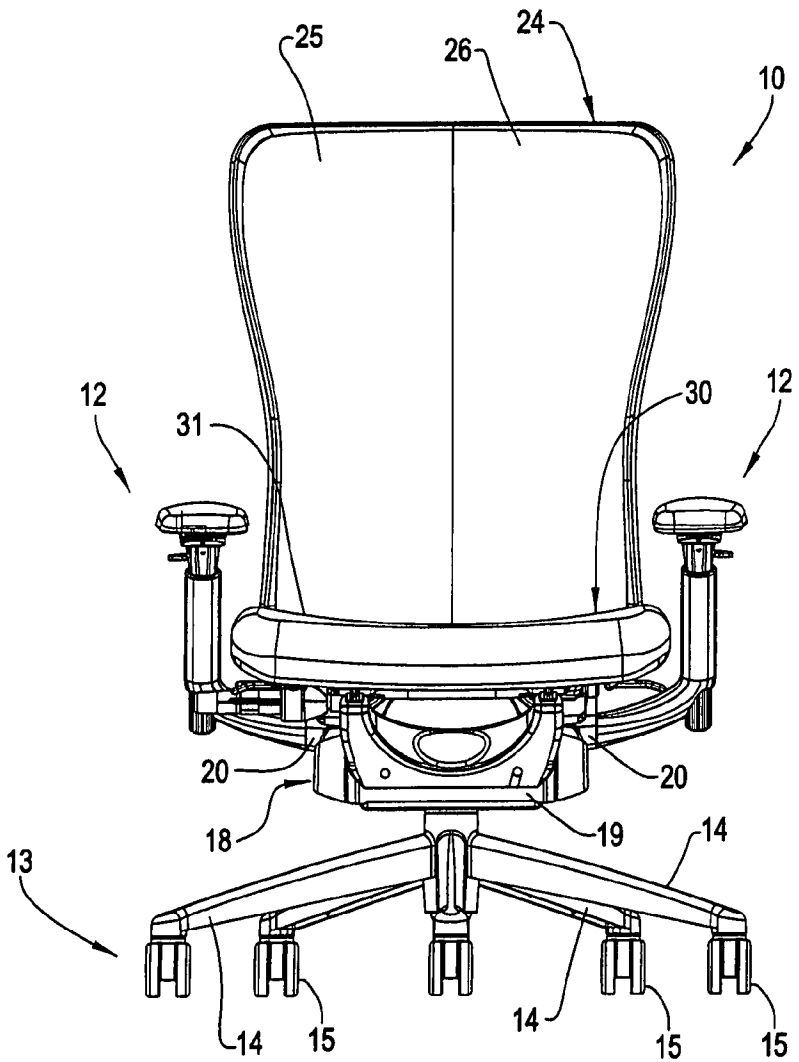
FIG. 1 is a front elevational view of an office chair having arm assemblies of the invention mounted thereon.
Figure 4:
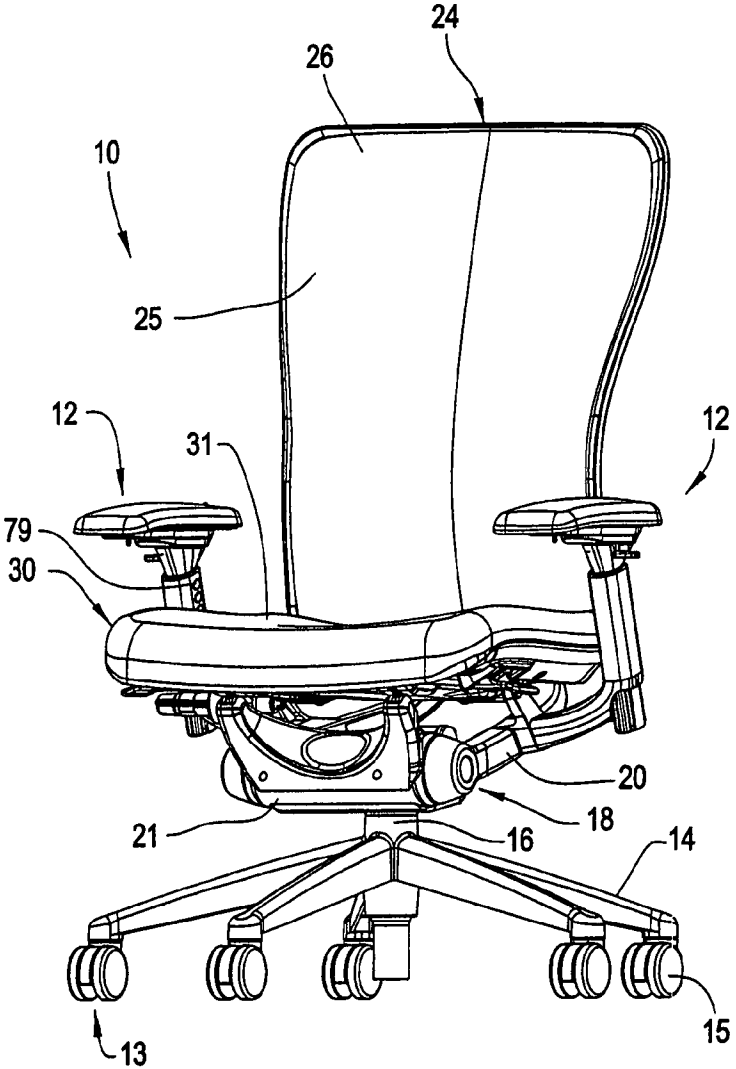
FIG. 4 is a front isometric view of the chair.
Figure 3:
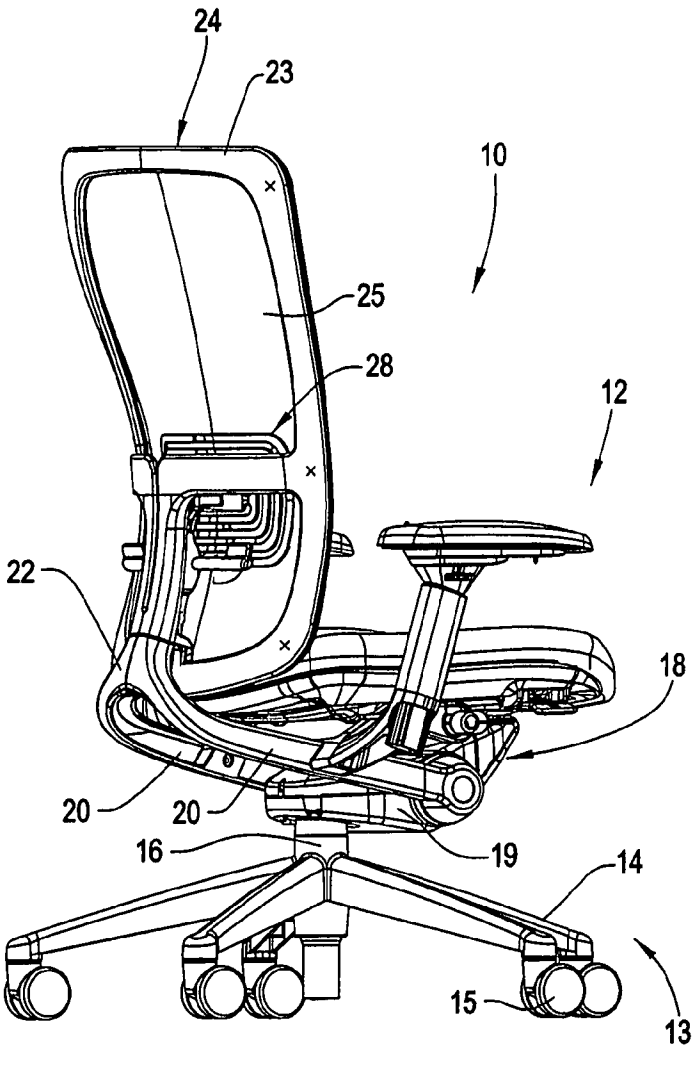
FIG. 3 is a rear isometric view of the chair.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the invention generally relates to an office chair 10 which includes various inventive features therein to improve the overall comfort and adjustability of the chair 10. More particularly, this chair 10 includes improved height-adjustable arm assemblies 12 which are readily adjustable to the different physical characteristics and comfort preferences of the chair's occupant.

Generally as to the chair 10, this chair 10 includes a base 13 having radiating legs 14 which are supported on the floor by casters 15. The base 12 further includes an upright pedestal 16 which projects vertically and supports a tilt control mechanism 18 on the upper end thereof. The pedestal 16 has a pneumatic cylinder therein which permits adjustment of the height or elevation of the tilt control mechanism 18.

The tilt control mechanism 18 includes a control body 19 on which a pair of generally L-shaped uprights 20 are pivotally supported by their front ends. The uprights 19 converge rearwardly together to define a connector hub 22 on which is supported the back frame 23 of a back assembly 24. The tilt control mechanism is disclosed in U.S. Provisional Patent Application No. 60/657,524, filed Mar. 1, 2005, entitled TENSION ADJUSTMENT MECHANISM FOR A CHAIR, U.S. Provisional Patent Application Nos. 60/657,541, filed Mar. 1, 2005, and 60/689,723, filed Jun. 10, 2005, both entitled TILT CONTROL MECHANISM FOR A CHAIR, which are owned by Haworth, Inc., the common assignee of the present invention. The disclosures of these patent applications are incorporated herein in their entirety by reference.

The back assembly 24 has a suspension fabric 25 supported about its periphery on the corresponding periphery of the frame 23 to define a suspension surface 26 against which the back of a chair occupant is supported. The structure of this back assembly 24 is disclosed in U.S. Provisional Patent Application Ser. No. 60/657,313, filed Mar. 1, 2005, entitled CHAIR BACK, which is owned by Haworth, Inc. The disclosure of this patent application is incorporated herein in its entirety by reference.

To provide additional support to the occupant, the back assembly 24 also includes a lumbar support assembly 28 which is configured to support the lumbar region of the occupant's back and is adjustable to improve the comfort of this support. The structure of this lumbar support assembly 28 is disclosed in U.S. Provisional Patent Application Ser. No. 60/657,312, filed Mar. 1, 2005, entitled CHAIR BACK WITH LUMBAR AND PELVIC SUPPORTS, which is owned by Haworth, Inc. The disclosure of this patent application is incorporated herein in its entirety by reference.

Additionally, the chair 10 includes a slidable seat assembly 30 that defines an upward facing support surface 31 on which the seat of the occupant is supported.

More particularly as to the arm assemblies 12, these arm assemblies 12 are formed substantially identical to each other except that they are formed as mirror-images for mounting to the respective left or right side of the chair. Preferably, these arm assemblies 12 mount directly to the uprights 20 so as to be movable therewith during reclining of the chair 10.

These uprights 20 are pivotally connected to the tilt control housing 19 and are pivotable about a horizontal axis to effect rearward pivoting movement of the back assembly in unison with more limited, but downward pivoting of the seat assembly 30. The rearward tilting of the back assembly 24 and seat assembly 30 is controlled by the tilt control mechanism 18.

Figure 5:
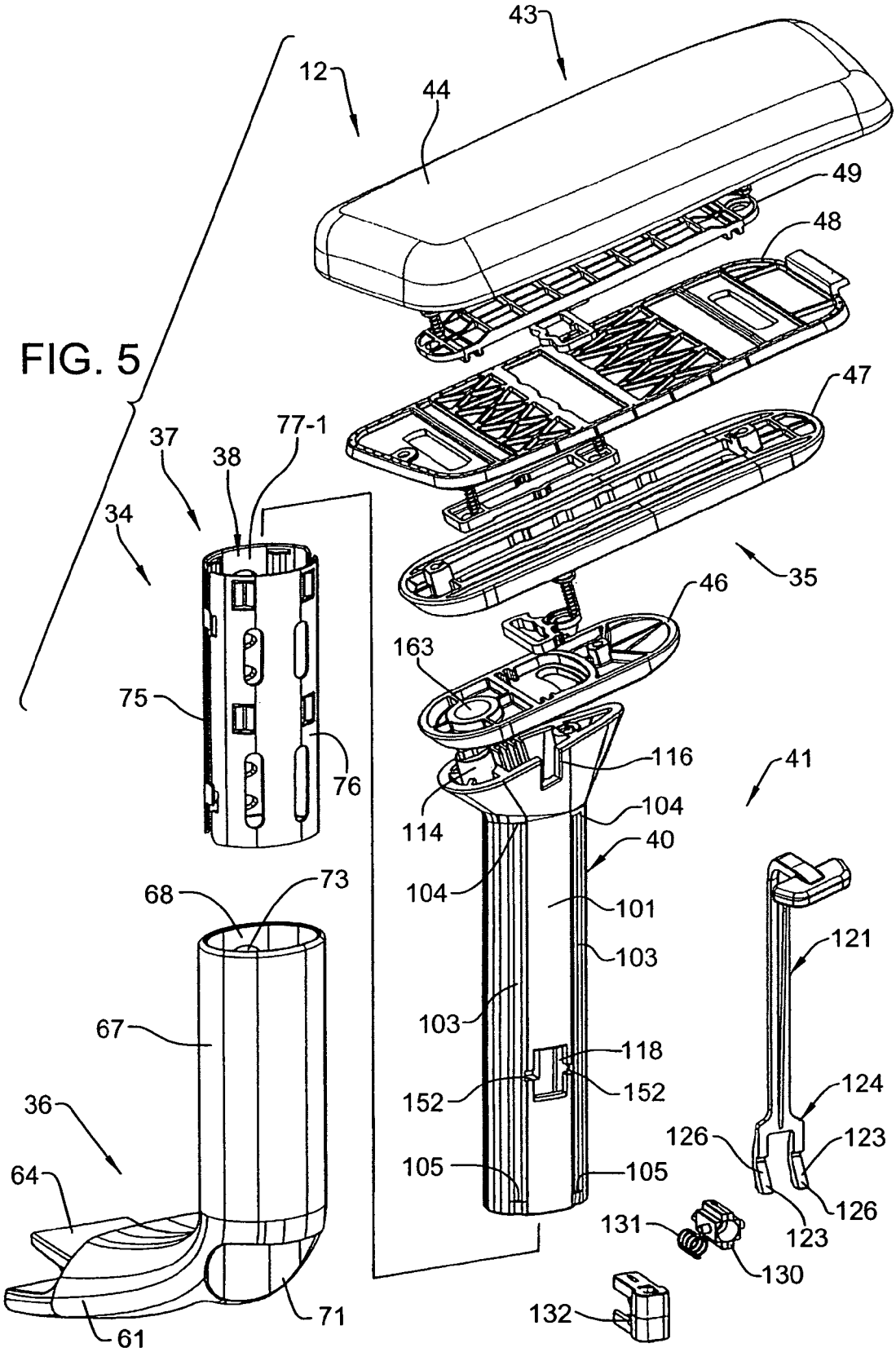
FIG. 5 is an exploded view of the arm assembly comprising a support post assembly and an armrest assembly.

More particularly as to the arm assembly 12, FIG. 5 is an exploded view of the arm assembly 12 which generally comprises a support post unit 30 and an arm cap or armrest assembly 31. The support post unit 30 comprises an upwardly-projecting support post 32 which is rigidly connected to a respective upright 20 and a tubular liner unit 37 which defines an upward-opening hollow interior 38. The hollow post interior 38 is adapted to receive the armrest assembly 35 in telescoping relation therewith.

More particularly, the armrest assembly 35 comprises a downwardly-projecting support column 40 (FIGS. 5 and 6) which is slidably received within the post interior 38 and is vertically movable to a selected elevation. To selectively lock the armrest assembly 35 at a selected elevation, the armrest column 40 includes a latching mechanism 41 disposed within the post column 40 which is adapted to engage the liner 37.

The armrest assembly 35 further includes an arm cap 43 (FIG. 5) that defines an upward facing support surface 44 for supporting the fore arms of the occupant. The arm cap 43 is movably connected to the support column 40 by an interconnected arrangement of stacked plates 46, 47, 48 and 49 (FIGS. 5 and 6).

As to these plates, pivot plate 46 pivots relative to the support column 40 to adjust the angular position of the arm cap 43. Slide plate 47 is slidably connected to the pivot plate 46 to thereby adjust the longitudinal, front-to-back position of the arm cap 43. A translatable subcap slide plate 48 is slidably interconnected to the intermediate slide plate 47 so as to be translatable in the transverse or sideward direction to adjust the relative sideward position of the arm cap 43. The subcap plate 48 is fixedly retained on the slide plate 47 by retainer plate 49 as will be discussed in further detail herein. This multi-layer arrangement of plates 46-49 thereby allows a high degree of adjustability for the arm cap 43 to accommodate the physical characteristics and comfort requirements of an occupant.

Figure 6:
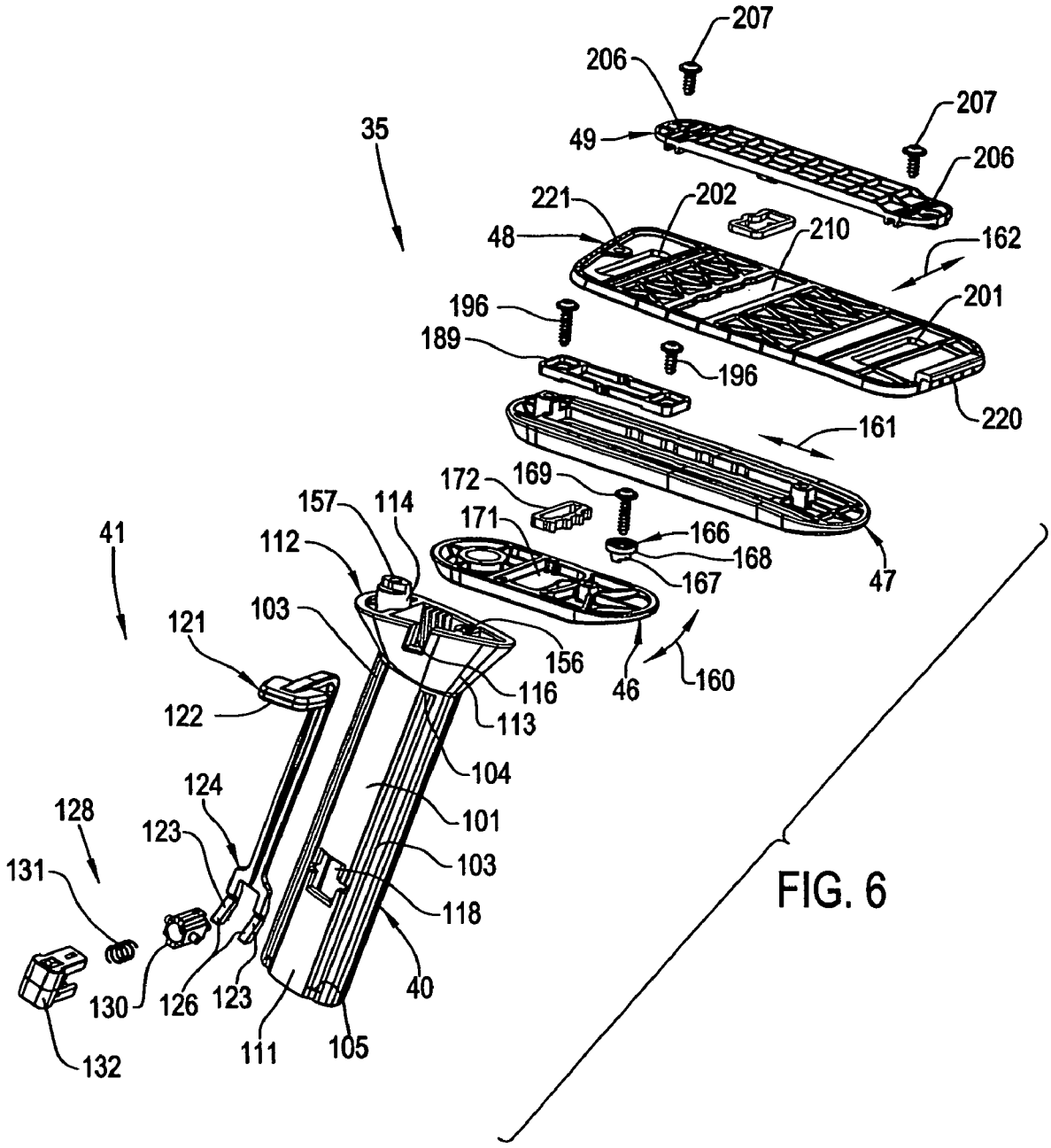
FIG. 6 is an exploded view of the armrest assembly.
Figure 7:
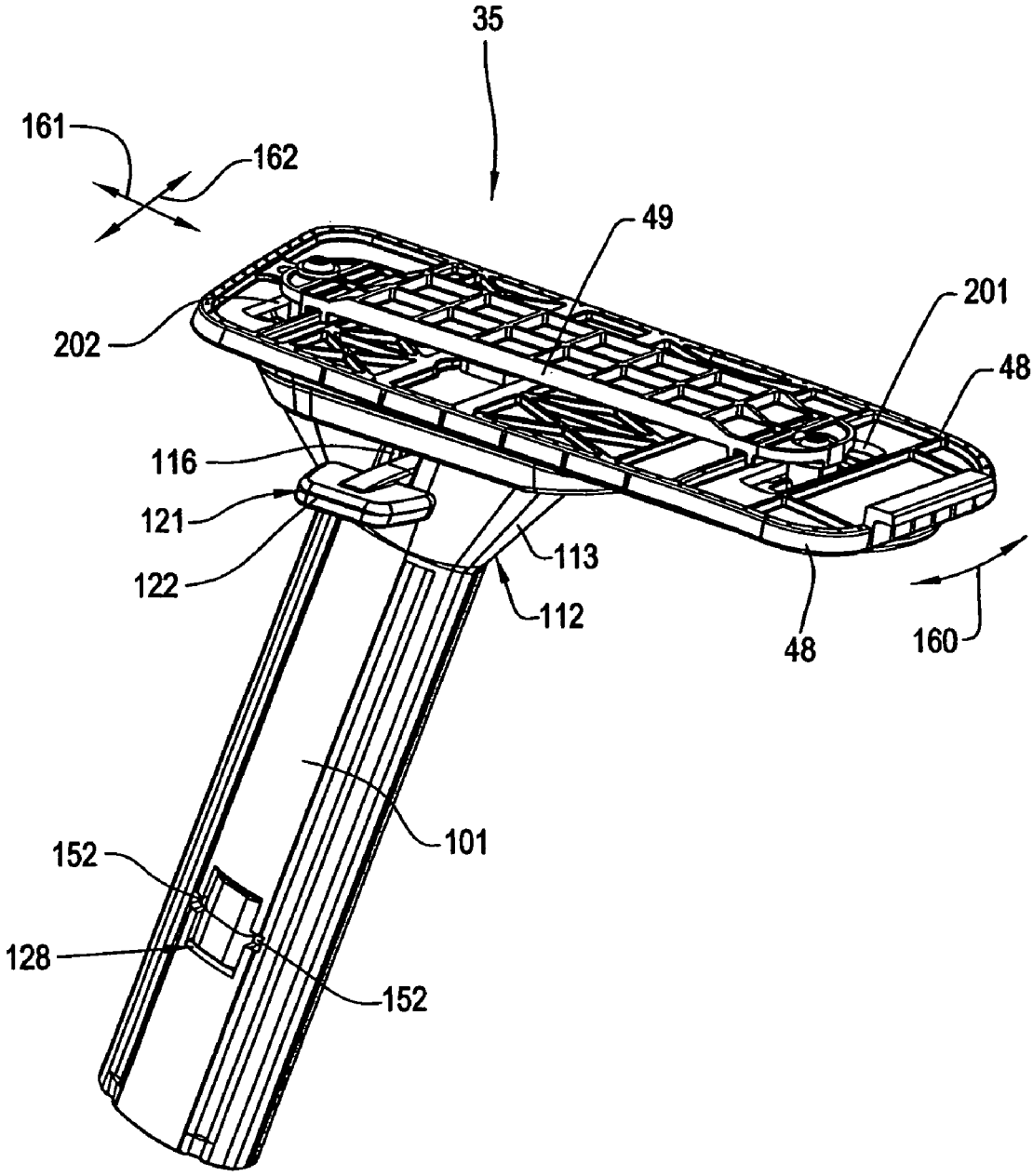
FIG. 7 is an assembled isometric view of the armrest assembly.

FIGS. 6 and 7 illustrate the components of the arm rest assembly 35 with FIG. 6 providing a front exploded view of the arm rest components and FIG. 7 providing an assembled view of these same components.

Figure 11:
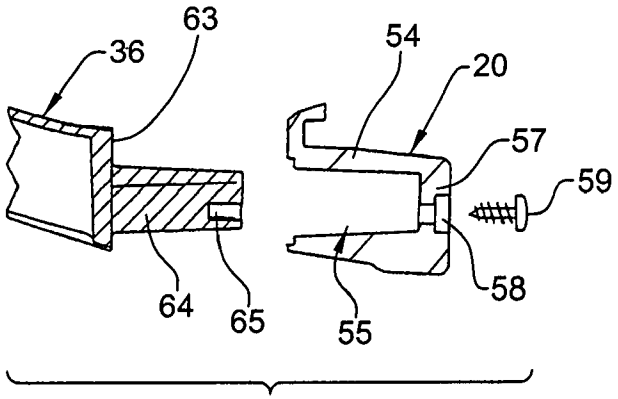
FIG. 11 is a partial exploded cross-sectional view of a connector arrangement between the arm assembly and the upright.
Figure 10:
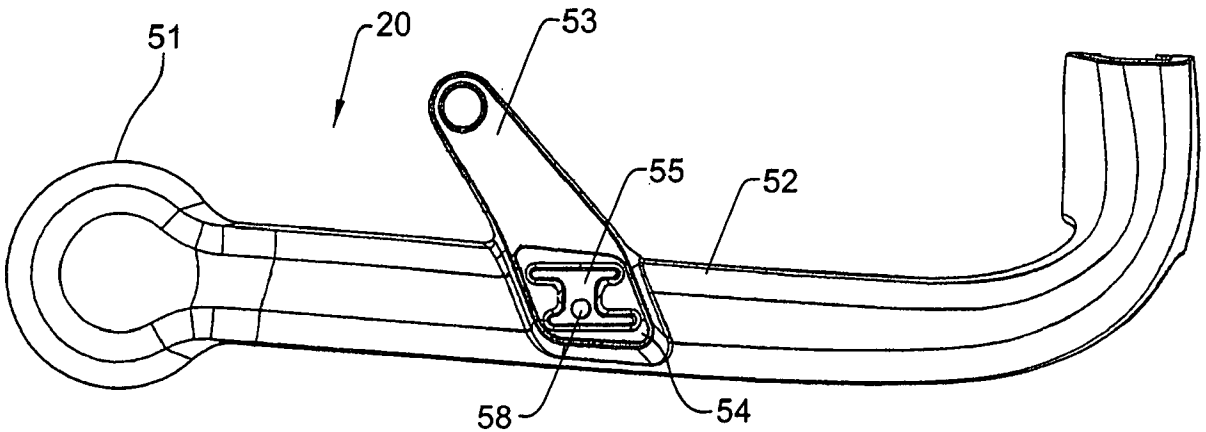
FIG. 10 is a left side view of a chair upright.

Referring to FIGS. 10 and 11 and the connection of the arm assembly 12 to the base 13, the arm assembly 12 is configured for mounting to a respective one of the uprights 20 with the left-side upright 20 being illustrated in FIG. 10. It will be understood that the right-side upright 20 is identical to but a mirror image of the left-side upright 20 (FIG. 10) and thus, a detailed discussion as to the right-side upright 20 is not required.

Each upright 20 includes a front end 51 which is configured so as to be pivotally connected to the control body 19 such that the uprights 20 pivot downwardly and upwardly together about a horizontal axis, which extends across the transverse width of the tilt control mechanism 18. Each upright 20 therefore extends rearwardly to an intermediate portion 52 on which is formed an upwardly extending bracket 53 that is adapted to be engaged with and support the seat assembly 30. This intermediate portion 52 further includes a connector section having a generally I-shaped mounting socket 55 for engagement with the support post 36 (FIG. 11). The side walls of the mounting socket 55 taper inwardly as illustrated in FIG. 11 and terminate at a socket bottom wall 57 which closes off the inner end of the socket 55. The bottom wall 57 is formed with a fastener bore 58 that is adapted to receive a threaded fastener 59 horizontally therethrough from the interior side of the upright 20.

Turning to the mounting of the arm assemblies 12, (FIGS. 12 and 13), the support post 36 has a generally L-shaped configuration defined by a horizontal leg 61 which terminates at an inner end 62 and defines an end face 63. Preferably, the entire support post 36 is formed by die casting of rigid metal, such as aluminum.

Figure 13:
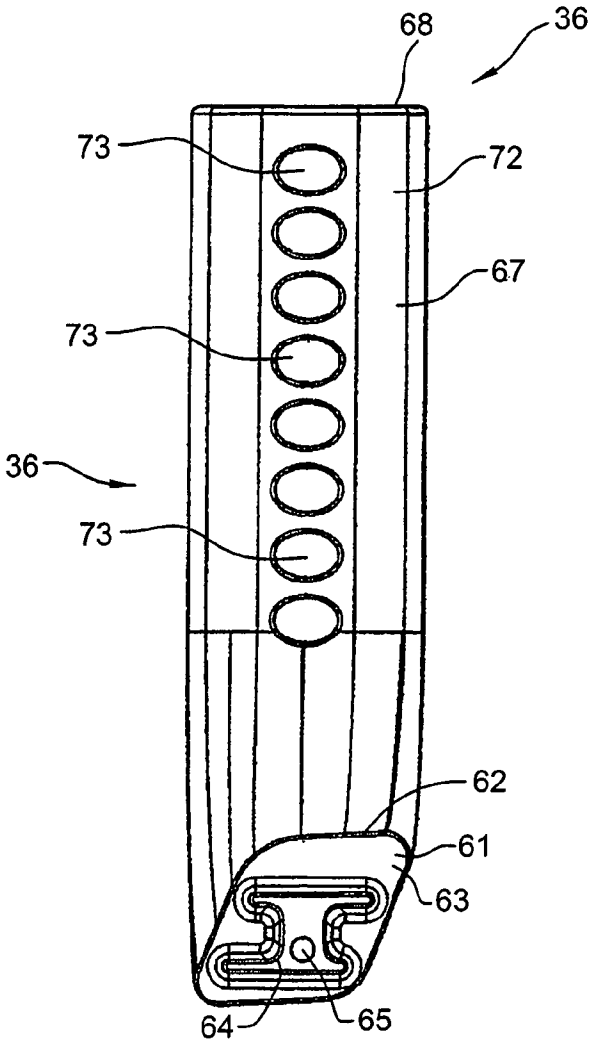
FIG. 13 is an inner side view of the support post.
Figure 12:
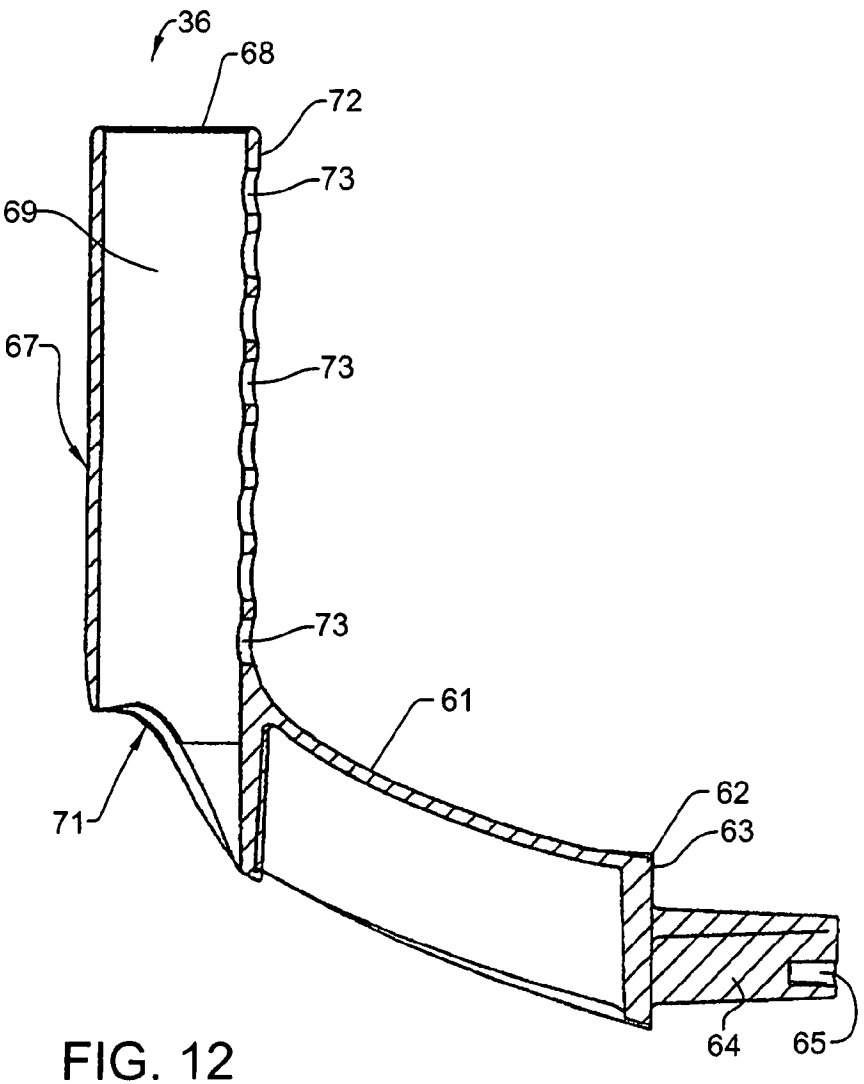
FIG. 12 is a front cross-sectional view of a support post.

The post 36 further includes a connector bayonet 64 that projects sidewardly and has a generally I-shaped cross-sectional configuration as illustrated in FIG. 13. This bayonet 64 has tapered side surfaces as best illustrated in FIGS. 11 and 12 wherein the I-shaped configuration matches the shape of the corresponding socket 55. The distal end of the bayonet 64 is formed with a blind bore 65 that aligns in registry with the fastener bore 58. As such, the bayonet 64 may be plugged into or seated within the socket 55 in tight-fitting, snug engagement and thereafter, the bayonet 64 and upright 20 are drawn sidewardly together and snugly fitted by threaded engagement of the fastener 59 with the blind bore 65. As such, the post 36 is rigidly fixed on its respective upright 20.

Referring to FIGS. 5, 12 and 13, the outermost end of the horizontal leg 61 supports an upright tubular section 67 which has an open upper end 68. The tubular section 67 defines an open interior 69 which interior 69 extends downwardly and opens through a generally oval shaped bottom opening 71. The bottom opening 68 is aligned vertically with the upper opening 68 to define a continuous passage extending vertically through the tubular post section 67.

On its inside face 72 (FIGS. 12 and 13), the tubular section 67 includes a row of side ports or cavities 73 which are vertically spaced apart one above the other and open horizontally through the thickness of the post wall.

Figure 8:
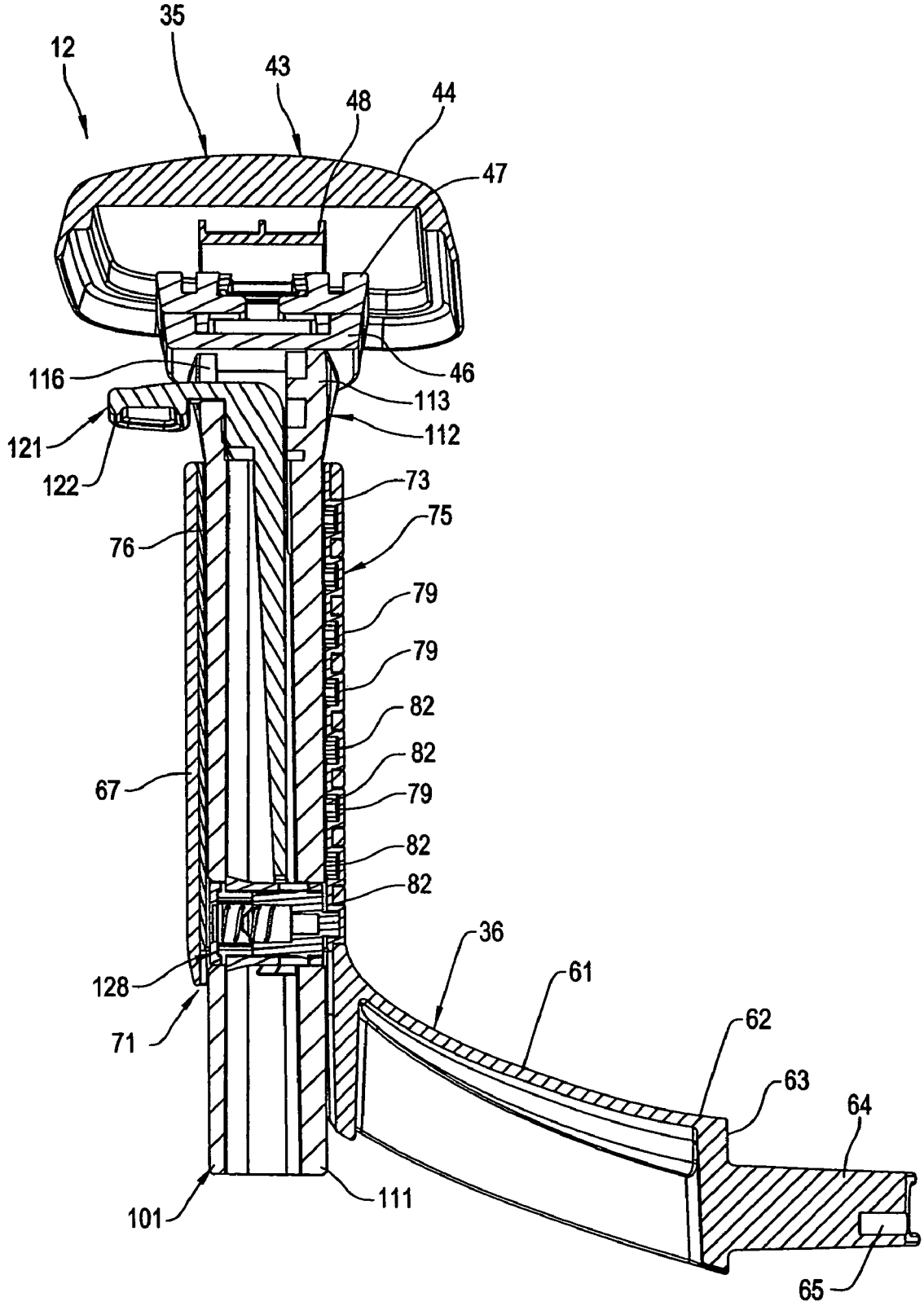
FIG. 8 is a front cross-sectional view of the arm assembly.

The support post unit 34 further includes the aforementioned liner unit 37, which liner unit 37 is formed of a reduced-friction plastic material. As seen in FIGS. 5 and 8, the liner unit 37 extends circumferentially of the tubular sections 67 and preferably is formed of a two-piece construction comprising a first locking liner 75 and a second non-locking liner 76. The two liners 75 and 76 are each inserted one at a time into the tubular post section 67 and define the interior space into which the support column 40 is slidably inserted. As described in further detail herein, the locking liner 75 is first positioned within the tubular post section 67 and then the non-locking second liner 76 is inserted into position. The locking liner 75 is further configured to cooperate with the latching mechanism 41 to selectively prevent vertical adjustment of the elevation of the arm rest assembly 35.

Referring to FIGS. 15-19, these figures illustrate the locking liner 75. The locking liner 75 has an arcuate cross sectional shape (FIG. 19) which conforms to the inside face and shape of the tubular post section 67. This shape is defined by the liner side wall 77 which is formed of a molded plastic having various features incorporated therein.

First as to these features, the liner side wall 77 includes a plurality of hollow locking projections 79, the number, location and shape of which conform to the row of side ports 73 formed in the tubular post section 67. As such, each locking projection 79 snugly fits into the oval side ports 73 (as illustrated in FIG. 8) to thereby prevent vertical shifting of the locking liner 75 within the support post 36.

Figure 18:
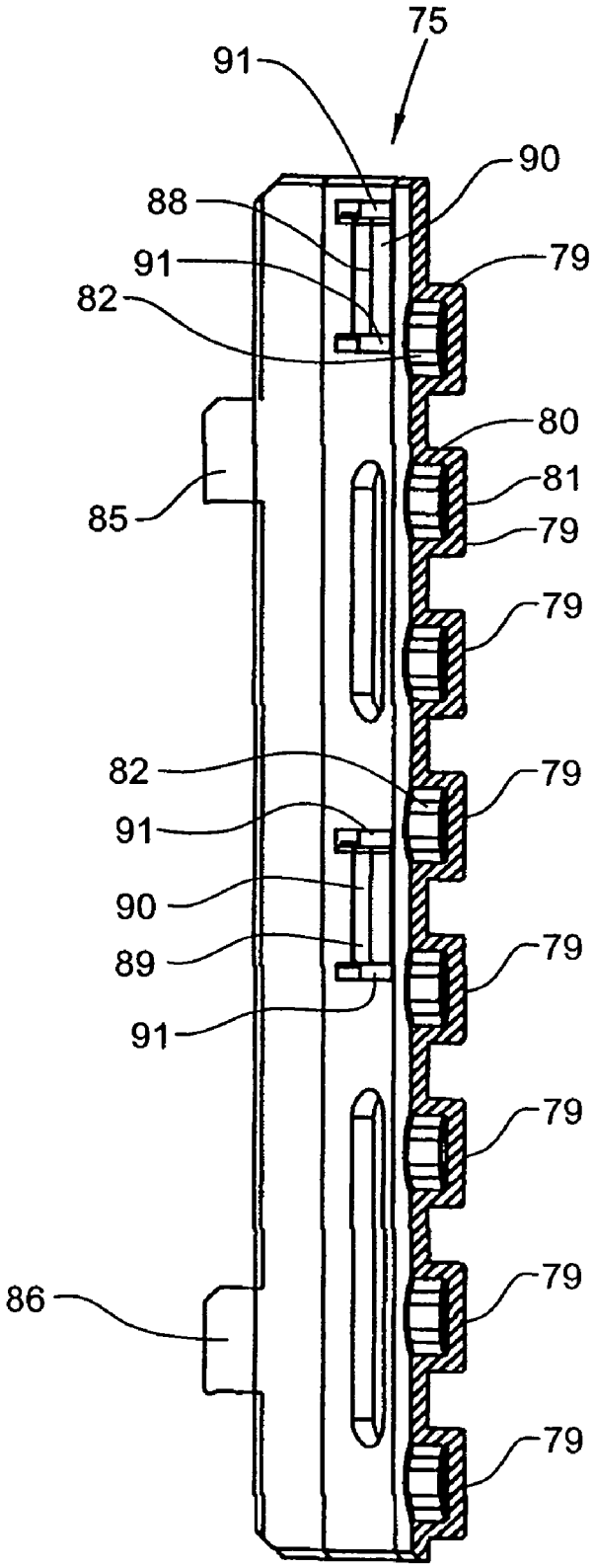
FIG. 18 is a cross-sectional end view of the locking liner as taken along line 18-18 of FIG. 16.
Figure 19:
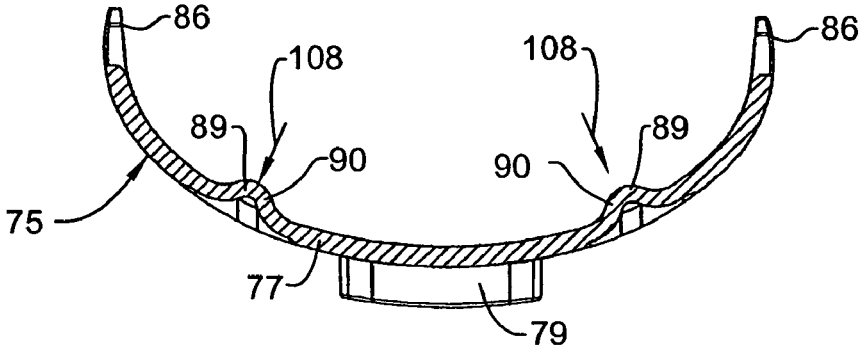
FIG. 19 is a top cross-sectional view of the locking liner as taken along line 19-19 of FIG. 16.

More particularly as to FIG. 18, each locking projection 79 has a generally cylindrical shape defined by an outwardly projecting, annular side wall 80 which terminates and is closed off by an outer end wall 81 to thereby define a blind bore 82, wherein each blind bore 82 effectively defines a locking recess for engagement by the latching mechanism 41. The locking recesses 82 are vertically spaced apart and each define a respective elevation at which the arm cap 43 may be maintained by the latching mechanism 41.

Figure 17:
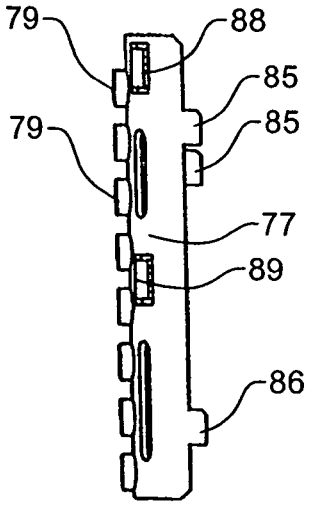
FIG. 17 is a front view of the locking liner.

The non-locking liner 76 and the locking liner 75 are interconnected to thereby prevent displacement of the non-locking liner 76 relative thereto. In this regard, the opposite vertical side edges 84 of the locking liner 75 are provided with respective pairs of tabs 85 and 86 which generally project circumferentially relative to the arcuate shape of the liner side wall 77. It is noted that the upper tabs 85 are vertically offset relative to each other as can be seen in FIG. 17, while the lower pair of tabs 86 are aligned with each other.

The support post unit 34 further is configured to define the upper and lower limits of travel for the telescoping movement of the arm rest assembly 35 relative to the support post unit 34. In this regard, the locking liner 75 is molded so as to include an upper pair of stops 88 and a lower pair of stops 89. The upper stops 88 cooperate with the arm rest support column 40 to define the downward stop location for the arm rest assembly 35. The lower stops 89 are adapted to define the upward stop location for this arm rest assembly 35.

More particularly, each of the stops 88 and 89 is defined by an arcuate band of molded plastic 90 which bows radially inwardly and is separated from adjacent areas of the liner wall 77 along the top and bottom edges thereof by slots 91. The slots 91 permit radially outward deformation and deflection of these plastic bands 90 during installation of the arm rest assembly 35 within the hollow interior of the tubular post section 67. The function of the stops 88 and 89 is described in further detail herein with respect to the arm rest assembly 35.

During installation, the locking liner 75 is slid downwardly into the upper open end 68 of the tubular post section 67 and then shifted sidewardly so that the locking projections 79 fit into the respective side ports 73 which side ports 73 thereby prevent vertical displacement of the liner 75 after installation. Thereafter, the opposite non-locking liner 76 is fitted downwardly and then shifted sidewardly so as to be interconnected with the locking liner 75.

Figure 21:
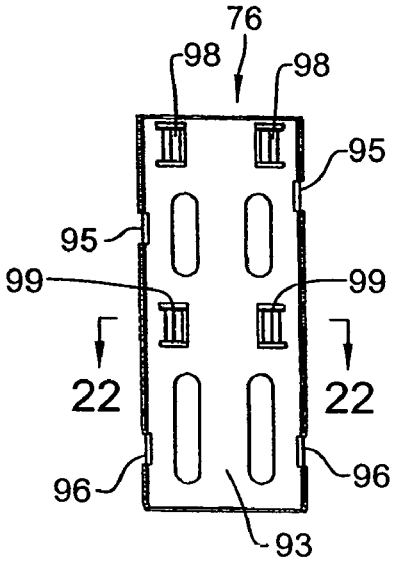
FIG. 21 is a side elevational view of the non-locking liner.
Figure 20:
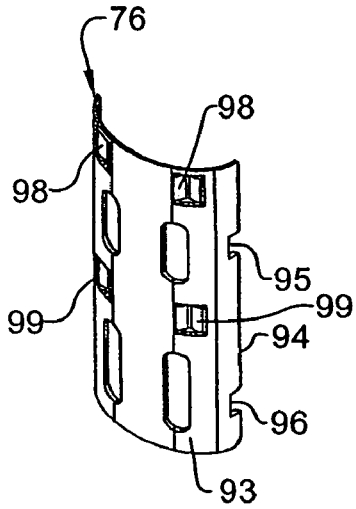
FIG. 20 is an isometric view of a non-locking liner.
Figure 22:
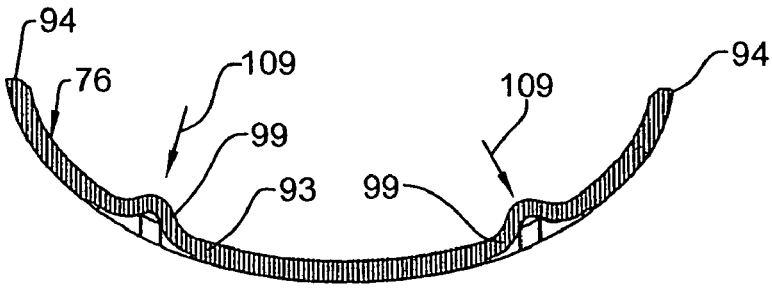
FIG. 22 is a top cross-sectional view of the non-locking liner as taken along line 22-22 of FIG. 21.

More particularly as to the liner 76, FIGS. 21-22 illustrate this liner. This liner 76 has an arcuate shape defined by the liner side wall 93. The opposite vertical side edges thereof include upper notches 95 and lower notches 96 as seen in FIG. 21. The upper notches 95 are vertically offset relative to each other so as to be aligned and interfit with the respective tabs 85 on the opposite liner 75. The lower notches 96 are aligned relative to each other and interfit with the respective tabs 86. The offset provided in the upper notches 95 and tabs 85 ensures proper orientation of the liner 76 relative to the liner 75.

Further, the liner 76 includes radially arcuate upper and lower stops 98 and 99 which are formed substantially identical to and located at the same positions as the above-described stops 88 and 89. As seen in FIG. 22, the lower stops 99, like the upper stops 98, bow radially inwardly but are deflectable radially outwardly during installation of the arm assembly 35. The stops 98 serve as down stops for the arm assembly 35, while the other stops 99 serve as up stops.

Once the liners 75 and 76 are installed into the tubular post section 67, these liners 75 and 76 cover the entire inside surface of the post interior 69 and define a plastic interior face 77-1 along which the arm rest support column 40 is able to slide vertically.

Figure 14:
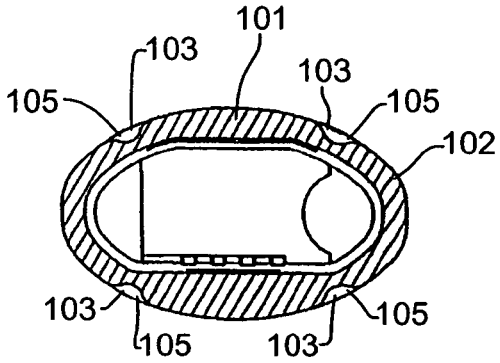
FIG. 14 is a top cross-sectional view of a support column of the armrest assembly as taken along line 14-14 of FIG. 25.
Figure 15:
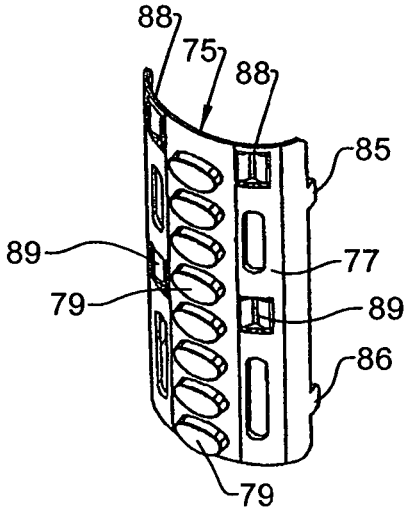
FIG. 15 is an isometric view of a locking liner for the support post.
Figure 16:
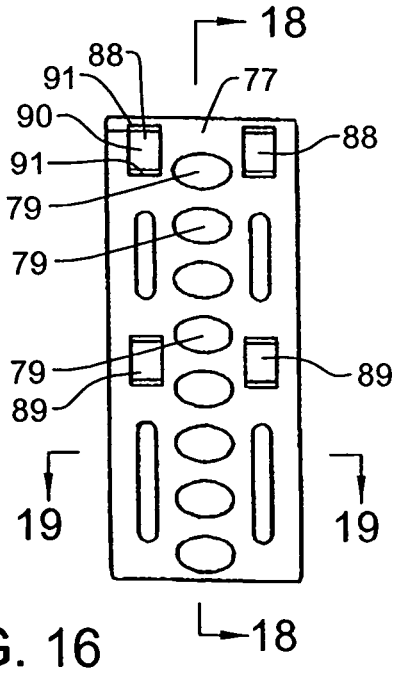
FIG. 16 is a side view of the locking liner.
Figure 25:
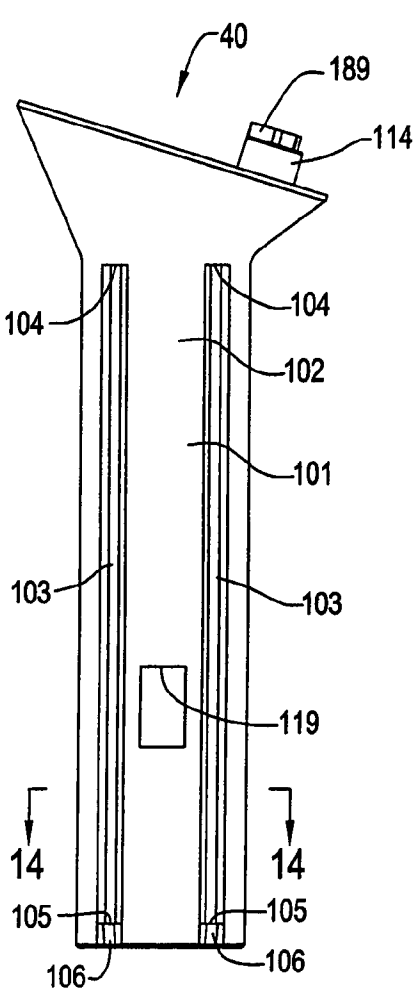
FIG. 25 is an inner side view of the armrest column.
Figure 24:
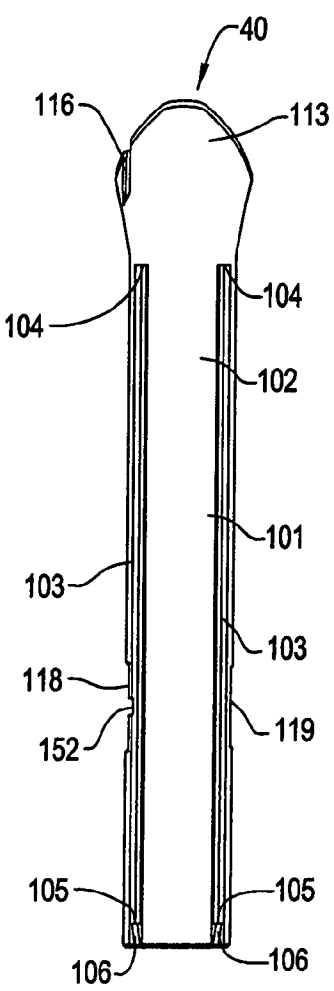
FIG. 24 is a front view of the armrest column.
Figure 23:
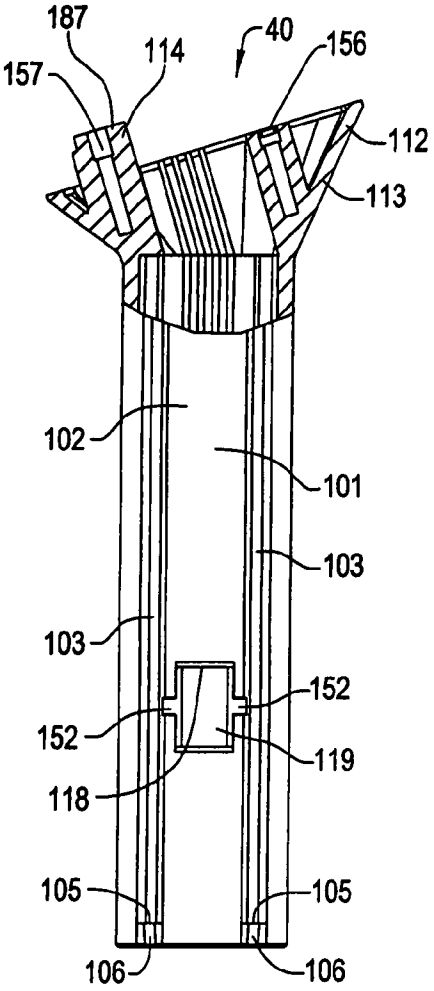
FIG. 23 is an outside side view and partial cross-section of the armrest column.

Referring more particularly to the connection of the arm-rest assembly 35 to the post unit 34, the support column 40 (as illustrated in FIGS. 23-25) is formed from a molded plastic material, preferably glass filled nylon, and is adapted to slidably fit within the vertical interior of the post unit 34. The column 40 includes a main vertical body 101 which has an oval cross-sectional shape (FIG. 14) which closely conforms to the oval shape defined by the inside faces of the liners 75 and 76. In particular, the column body 101 has an exterior surface 102 which is arcuate and substantially smooth except that it includes four circumferentially spaced guide channels 103. The guide channels 103 align with the various stops 88, 89, 98 and 99 of the liners 75 and 76. The guide channels 103 have a generally arcuate face which conforms to and is adapted to receive these various stops 88, 89, 98 and 99 so that when these stops are received within these channels 103, the column body 101 is still vertically slidable therealong.

The upper ends of the channels 103 terminate at end faces 104 that are defined as abrupt abutments which are adapted to abut against the upper edges of the corresponding upper stops 88 and 98. As such, during lowering of the arm rest assembly 43, these end faces 104 abut against the upper stops 88 and 98 to thereby define the downward limit of the arm rest assembly 43.

At the bottom end of each guide channel 103, bottom end walls 105 are formed which define upward facing abrupt abutments that are adapted to abut against the lower edge of the lower stops 89 and 99 to thereby define the upper limit of travel of the arm rest assembly 43. The lower end walls 105 are formed as solid formations and are not deflectable but have inclined surfaces 106 downwardly adjacent thereto which surfaces are inclined outwardly as illustrated in FIG. 24. These inclined surfaces 106 are adapted to abut against the respective stops 88, 89, 98 and 99 during downward insertion of the column body 101 into the liner assembly 37. These inclined surfaces 106 cause the various stops to deflect radially outwardly as generally indicated by reference arrows 108 and 109 in FIGS. 19 and 22 to provide clearance and permit insertion of the column body 101. Once installed, the stops 88, 89, 98 and 99 return to the condition illustrated in FIGS. 19 and 22 such that the bottom channel end walls 105 merely abut against the lowermost stops 89 and 99 and prevent removal of the column body 101 therefrom.

As such, the column body 101 is vertically slidable in telescoping relation within the posts 36. As seen in FIG. 8, when the column body 101 is at its lowest extent of travel, the lower end 111 of the column body projects downwardly out of the post opening 71. However, when fully raised, the lower body end 111 is able to travel upwardly into the interior of the tubular post section 67 to the location of the lower stops 89 and 99.

Additionally, the column body 101 is hollow in that it includes an interior chamber that extends along the entire vertical length of the support column 40 which interior chamber is adapted to receive the latching mechanism 41 therein. More particularly, the upper end of the column body 101 is an enlarged hub 112 defined by an annular hub wall 113. The rear end of the hub 112 includes an upstanding pivot shaft 114, the function of which will be described in further detail hereinafter. The inner side of the hub wall 113 is formed with a rectangular notch 116 (FIGS. 5, 6 and 8) which opens sidewardly therethrough.

To accommodate the latching mechanism 41, the column body 101 includes an installation window 118 (FIGS. 5, 6 and 23) and a latch window 119 opposite to the installation window 118. The latch window 119 is generally aligned with the vertical row of the latch recesses or bores 82. The installation window 118 and latch window 119 thereby accommodate and permit installation and operation of the latching mechanism 41.

The latching mechanism 41 includes an actuator lever 121 (FIGS. 5, 6 and 8). Lever 121 is vertically elongated so as to fit within the hollow interior of the column body 101 as generally illustrated in FIG. 8. The lever 121 is L-shaped and terminates at the upper end thereof with a hand piece 122 that projects sidewardly through the hub notch 116 as seen in FIG. 8. Therefore, the hand piece 122 is accessible for manual lifting by the chair occupant to thereafter effect vertical displacement of the lever 121. The lower end of the lever 121 has a forked section 124 that terminates with a pair of spaced apart actuator legs 123 that have inclined cam surfaces 126. Therefore, upon lifting of the hand piece 122, the lever 121 is displaced vertically upwardly, which therefore actuates a cassette assembly 128 that performs the latching function.

Figure 26:
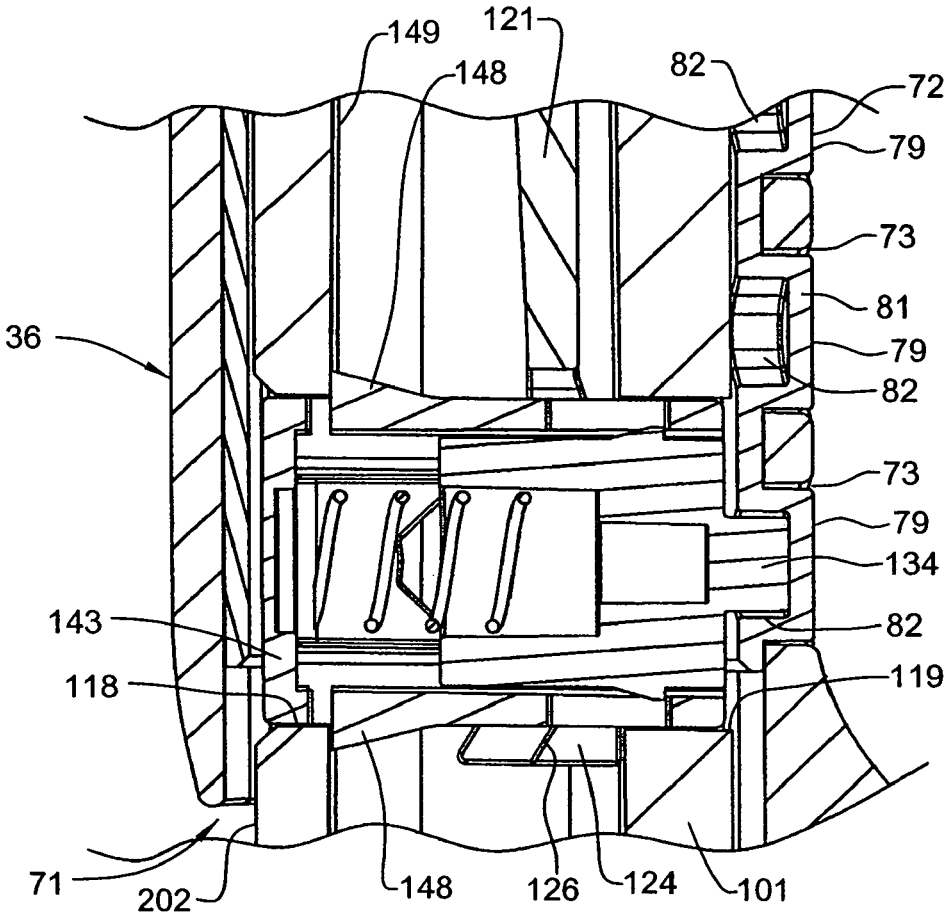
FIG. 26 is an enlarged front cross-sectional view of a latch mechanism mounted within the armrest.
Figure 27:
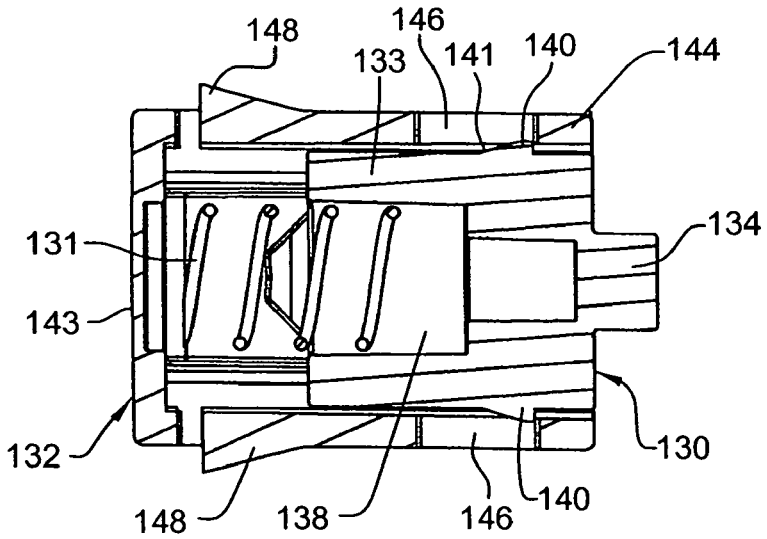
FIG. 27 is a front cross-sectional view of the latch assembly.
Figure 28:
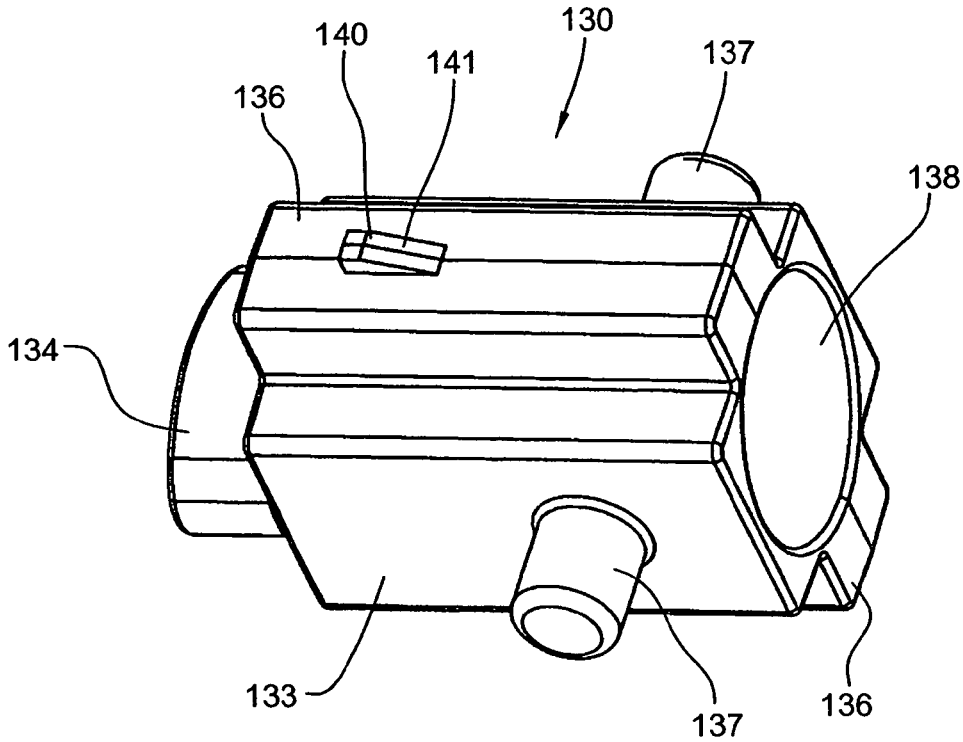
FIG. 28 is a rear isometric view of a slidable latch for the latch assembly.
Figure 29:
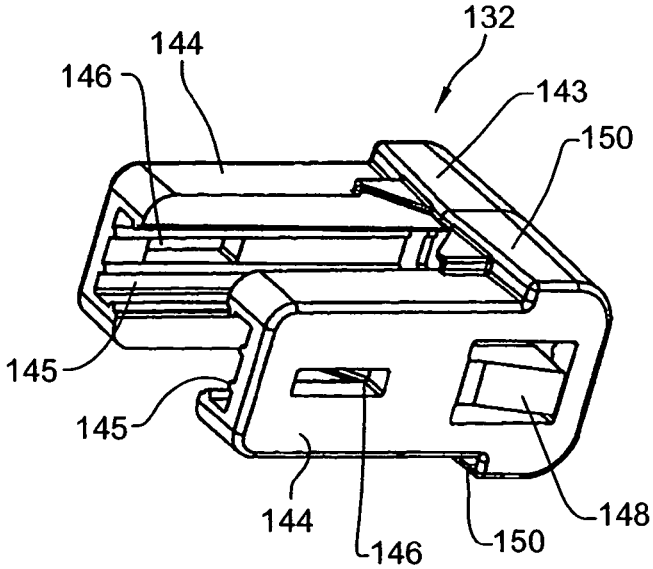
FIG. 29 is a rear isometric view of a latch case or housing.

Referring generally to FIGS. 5 and 6, the cassette assembly 129 includes a slidable latch 130, a biasing spring 131 and a cassette case or housing 132 which are all assembled together prior to installation within the column body 101. Referring to FIGS. 27-29, the slidable latch 130 (FIG. 28) generally is a molded plastic block having a central body 133 formed with an end projection 134. The end projection 134 has an oval shape which corresponds to the oval shape of each stop bore 82 and therefore is slidable sidewardly into engagement therewith as illustrated in FIG. 26.

The opposite sides of the central latch body 133 are formed with enlarged guide ribs 136, and a pair of actuator pins 137 projecting from the remaining two sides of the central body 133. The end of the body 133 opposite to the projection 134 includes a blind spring bore 138. Additionally, the guide ribs 136 include raised stops 140 which have a ramp-like face 141 to facilitate assembly.

As to the cassette housing 132, this housing 132 includes an end section 143 which supports a pair of spaced apart arms 144 to generally define a U-shape for the housing 132. The arms 144 include elongate guide channels 145 on the inside face thereof which open inwardly in opposing relation with each other and open sidewardly from the end of the housing 132 so as to slidably receive the corresponding guide ribs 136 of the latch 130 therein which thereby permits the slidable latch to be received into the housing 132.

The arms 144 each include a slot 146 which is adapted to align with and receive the latch stops 140. These slots 146 are elongate so as to permit displacement or sliding of the latch 130 within the housing 132 during operation. The above-described spring 131 is received within the spring bore 138 and abuts against the inside face of the housing end portion 143 to normally bias the latch 130 outwardly to the position illustrated in FIG. 27 while also permitting inward displacement of this latch 130.

Figure 9:
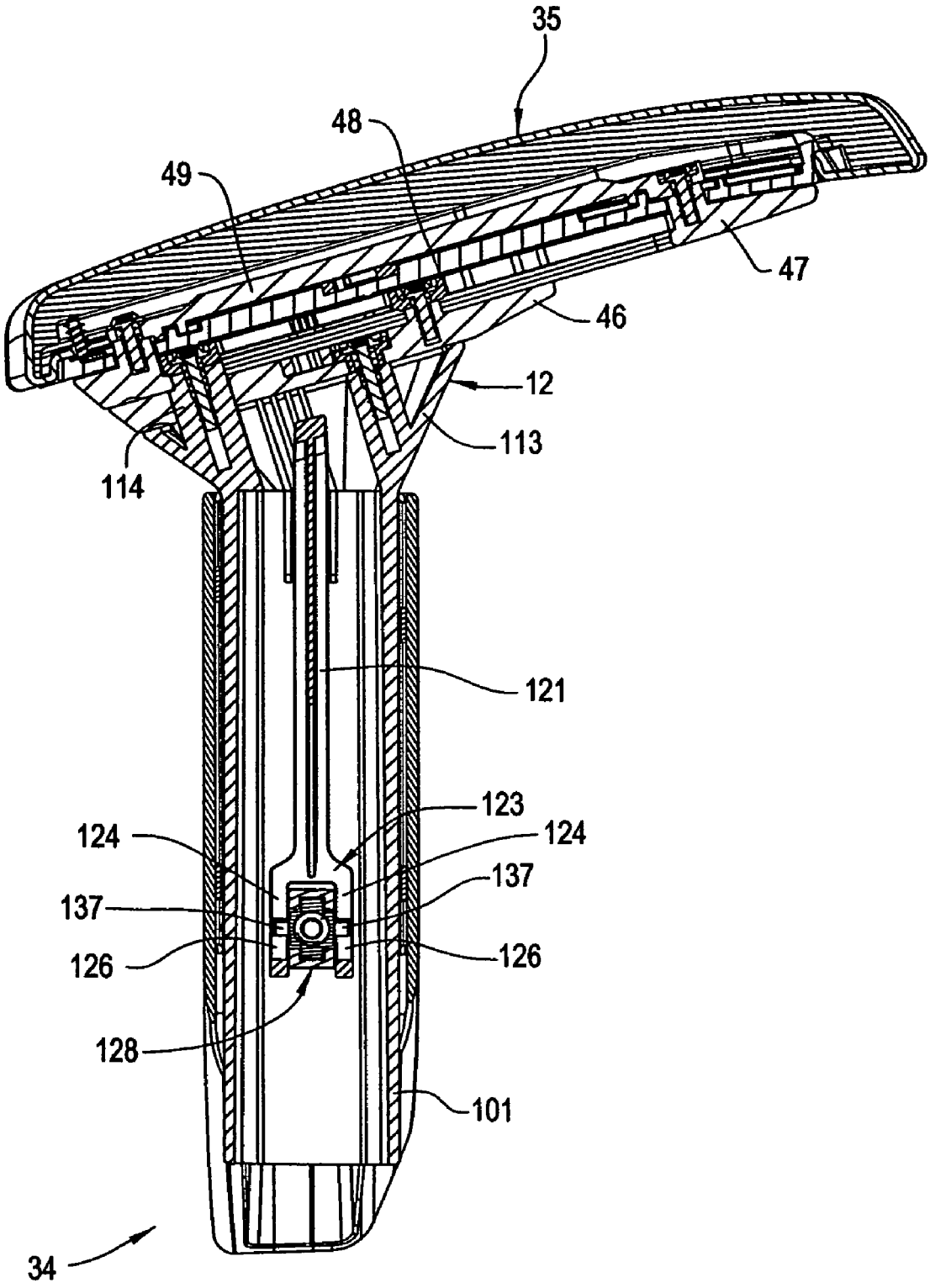
FIG. 9 is a side cross-sectional view of the arm assembly.

It is noted that the actuator pins 137 of the latch 130 project sidewardly from the spaces between the housing arms 144 so that they are able to abut against and cooperate with the forked section 123 of the lever 121. Referring more particularly to FIG. 9, this figure illustrates the actuator pins 137 in engagement with the individual legs 124 of the forked section 123. Since the legs 124 are tapered, vertical displacement of the slide lever 121 in the upward direction causes the pins 137 to be displaced sidewardly which thereby pulls the latch 130 into the interior of the cassette housing 132 which in turn disengages the latch projection 134 from the corresponding stop bore 82. Thus, vertical displacement of the slide lever 121 disengages the latch 130 and thereby permits vertical movement of the arm rest assembly 35 so long as the slide lever 121 is being pulled upwardly by the chair occupant. Since the latch 130 is spring biased by the spring 131, this spring 131 further functions to help return the lever 121 to its lowered position (FIG. 8) since displacement of the latch 130 sidewardly helps to cam the slide member 121 downwardly.

To secure the cassette assembly 128 in its installed position (FIG. 26), the cassette housing 132 also includes cantilevered fingers 148 which deflect inwardly during insertion of the cassette housing 132 through the installation window 118 and then snap outwardly to abut against the inside face 149 of the column body 101. Referring to FIG. 29, the housing end portion 143 includes stepped edges 150 that abut against the outside face 102 of the column body 101 which thereby traps the thickness of the column body 101 between these stepped edges 150 and the cantilevered fingers 148.

It is noted that the installation window 118 also includes notches 152 (FIG. 23) which are adapted to permit passage of the latch actuator pins 137 through the window 118 during installation. In this manner, the cassette assembly 128 is first assembled by inserting the spring 131 into the cassette housing 132 and then snapping the slidable latch 130 into the housing 132. This cassette assembly 128 is then snap fitted into the installation window 118 and held in place by the spring fingers 148. The latch 130 is freely movable horizontally with the projection 134 thereof projecting outwardly of the column body 101 through the latch window 119 as seen in FIG. 26. Hence, lifting of the lever 121 causes the latch 130 to move sidewardly out of engagement for repositioning of the arm rest assembly 35.

Furthermore, in this manner, the slide lever 121 is installed merely by sliding same downwardly into the column body 101 and then is retained in place once the cassette assembly 128 is snapped into position.

Turning next to the connection of the arm cap 43 to the column 40, the column hub 112 is formed with a first fastener bore 156 (FIG. 23) in the front section thereof and a second fastener bore 157 in the upward-projecting pivot shaft 114.

Generally as to FIGS. 6 and 7, the plates 46-49 are provided to permit the arm cap 43 (FIG. 5) to move in multiple adjustment directions. In particular, the pivot plate 46 provides for angular displacement of the arm cap 43 generally in the direction of reference arrow 160 (FIGS. 6 and 7). The slide-plate 47 permits adjustment of the arm cap 43 in the direction of reference arrow 161 while the top subcap plate permits adjustment in the direction of arrow 162. The movement of these various plates 46, 47, and 48 is all permitted independently of each other in that the displacement of any one of these plates in the direction of any one of its respective adjustment directions does not require displacement in the other remaining directions such that any combination of angular, longitudinal front-to-back and transverse, side-to-side movement is permitted.

More particularly as to these structural components, the pivot plate 46 is adapted for angular displacement about the pivot shaft 114 that projects upwardly from the column hub 114. The pivot plate 46 includes a shaft bore 163 which extends vertically through the back end of the pivot plate 46 and receives the shaft 114. Initially during installation, the plate 46 is merely seated onto the shaft.

Figure 30:
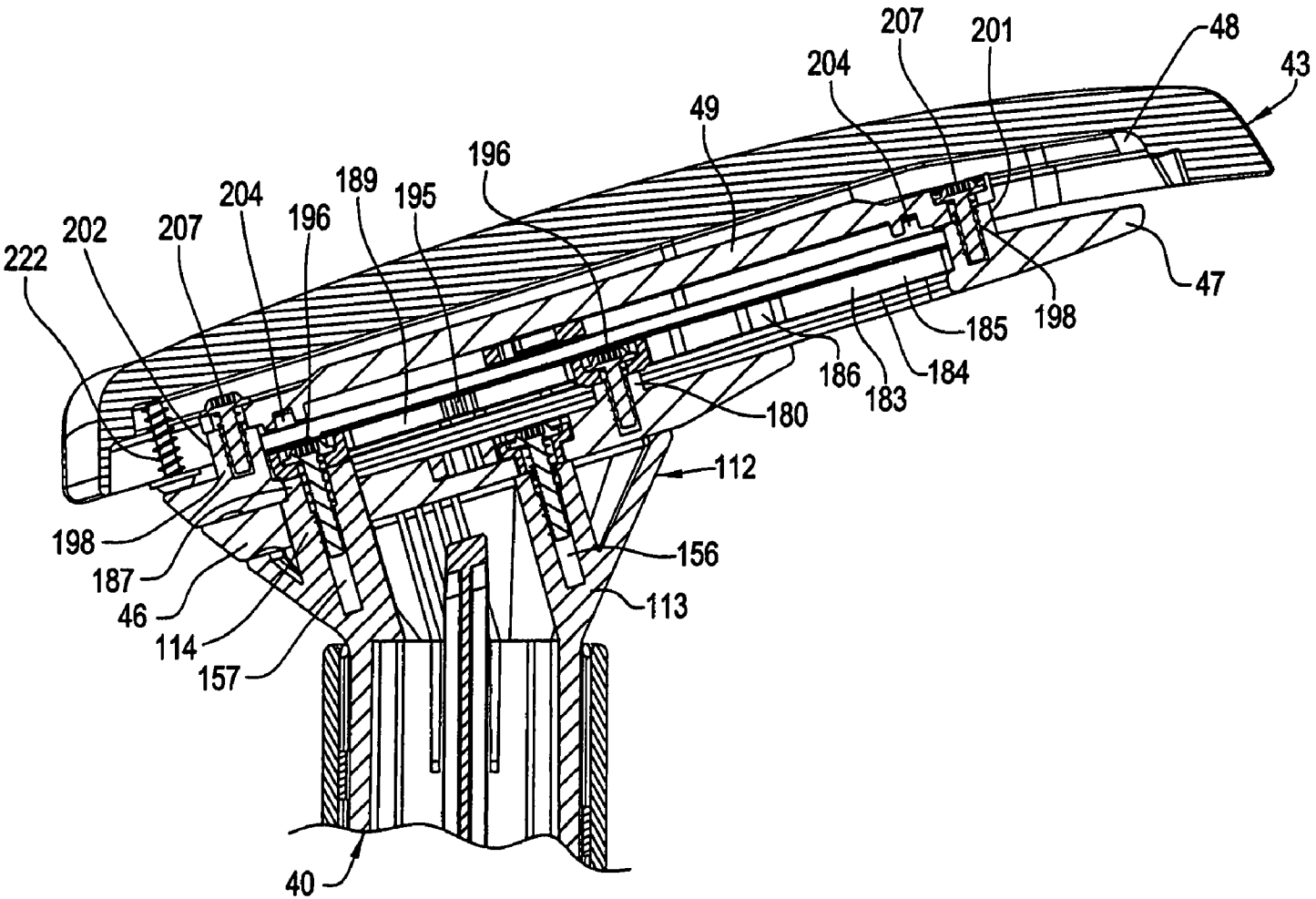
FIG. 30 is a cross-sectional view of the armrest assembly.

To control angular displacement of the pivot plate 46, this plate 46 includes an arcuate guide slot 164 which extends over the fastener bore 156. A cylindrical pivot bearing 166 is provided which has a lower shaft section 167 and enlarged head 168 as seen in FIG. 6. The shaft section 167 fits into the slot 164, and the bearing head 168 has a diameter larger than the slot 164 so as to effectively secure the pivot plate 46 in place and prevent removal from the column hub 112. A fastener 169 is inserted through the bearing 166 and threadedly engaged with the fastener bore 156 as seen in FIG. 30. During pivoting of the plate 46, the bearing 166 remains stationary while the slot 164 is displaced relative thereto. The opposite ends of the slot 164 define stop surfaces which abut against the bearing 166 to define the maximum limits of angular displacement of this pivot plate 46.

Figure 31:
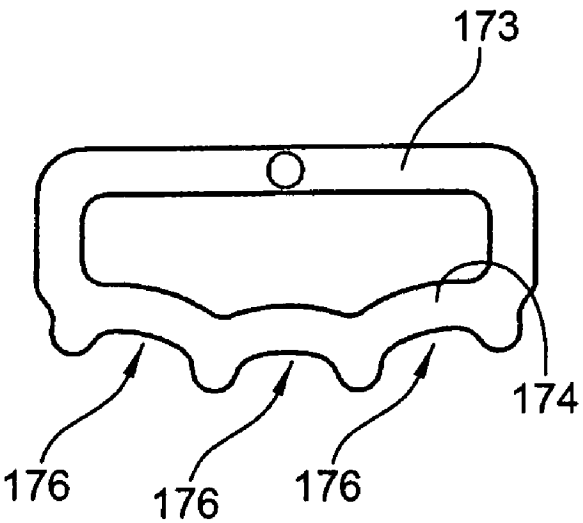
FIG. 31 is a plan view of a pivot detent for the armrest assembly for controlling the angular position of the armrest.
Figure 34:
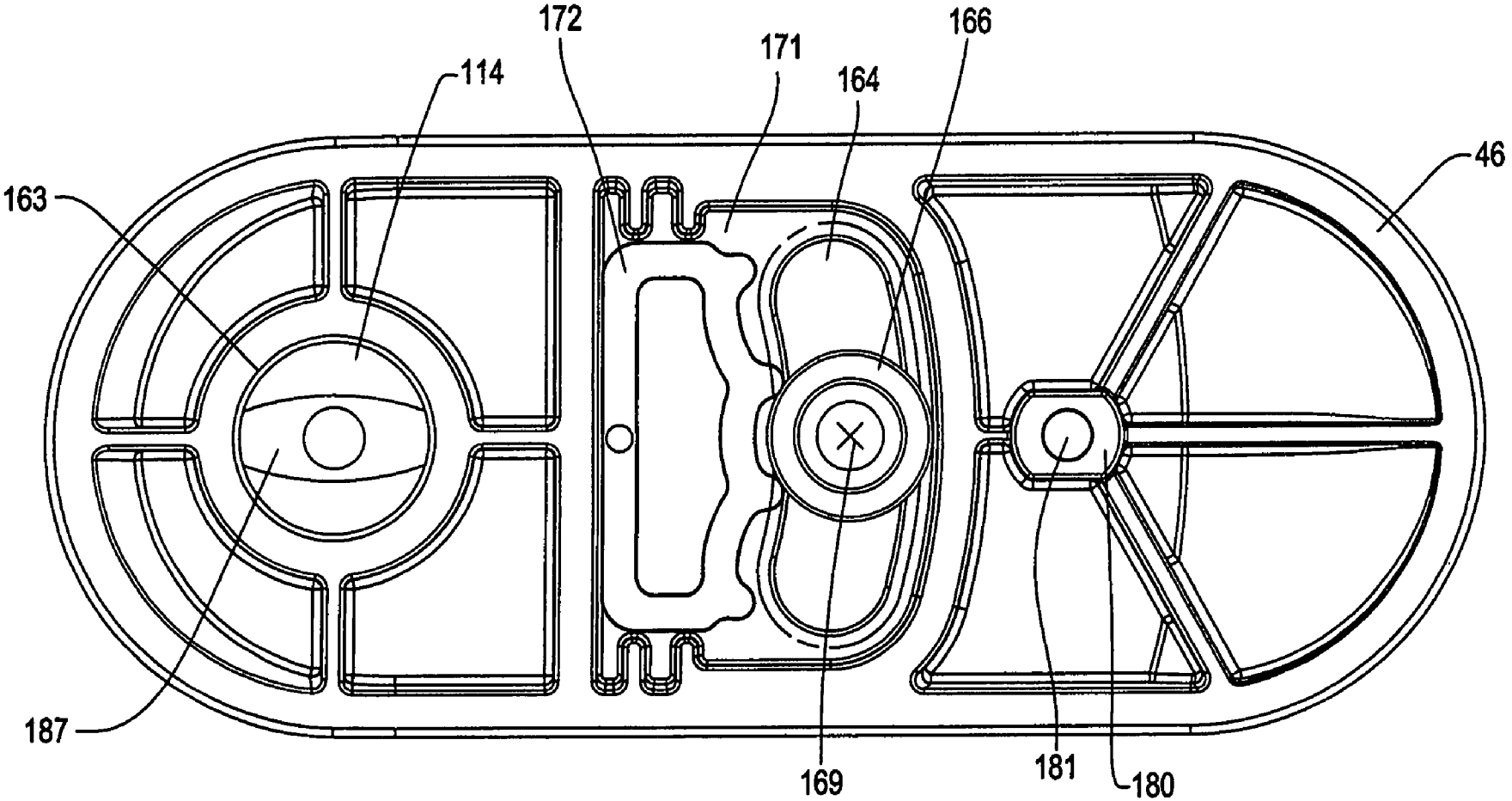
FIG. 34 is a plan view of a pivot plate with the pivot detent therein.

Adjacent to the slot 164, a detent cavity 171 is provided and an elastomeric pivot detent 172 is provided in this cavity. The detent 172 is illustrated in further detail in FIG. 31 and includes a generally U-shaped sidewall 173 and a deflectable front wall 174 The front wall 174 in the preferred embodiment has three bearing seats 176 separated and defined by projecting portions 177. The projecting portions 177 effectively work as cams in cooperation with the outer surface of the bearing 176 so as to effect inward deflection of the front wall 174 away from the bearing 166 during angular displacement of the pivot plate.

The pivot detent 172 is formed of an elastomeric deformable material and preferably is formed of urethane which allows for deflection of the front wall 174 while also resisting angular displacement of the pivot plate 46. While resisting pivoting, sufficient manual twisting of the arm cap 43 by the occupant will eventually reach a pivoting force which overcomes the normal deformation capacity of the urethane material. Hence, the detent 172 defines the threshold or capacity above which the arm cap 43 is displaceable angularly and below which the arm cap 43 is maintained in its angular position by the resiliency of this detent 172. The remainder of the arm cap assembly is supported on this pivot plate 46 such that pivoting movement of this pivot plate 46 allows the rest of the arm cap assembly to simply move angularly in unison therewith.

To further secure the remainder of the components onto this plate 46, the plate 46 also includes an upstanding post 180 having a vertical fastener bore 181 therein.

Figure 32:
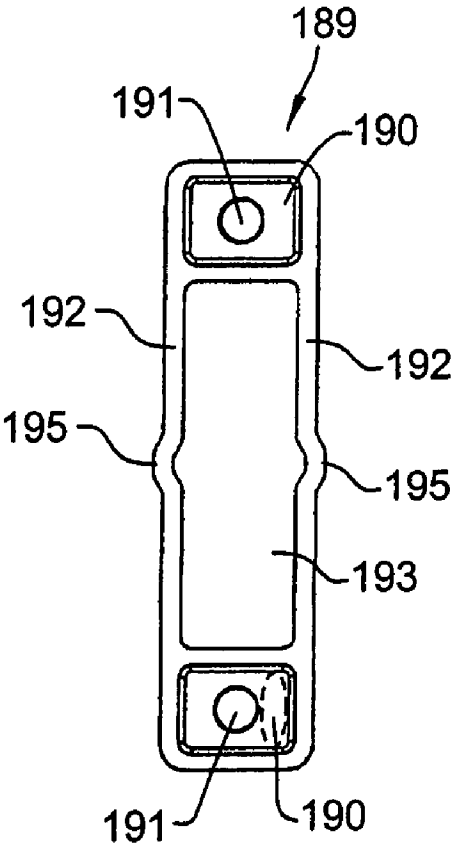
FIG. 32 is a plan view of a slide detent for controlling the longitudinal front-to-back position of the armrest.
Figure 35:
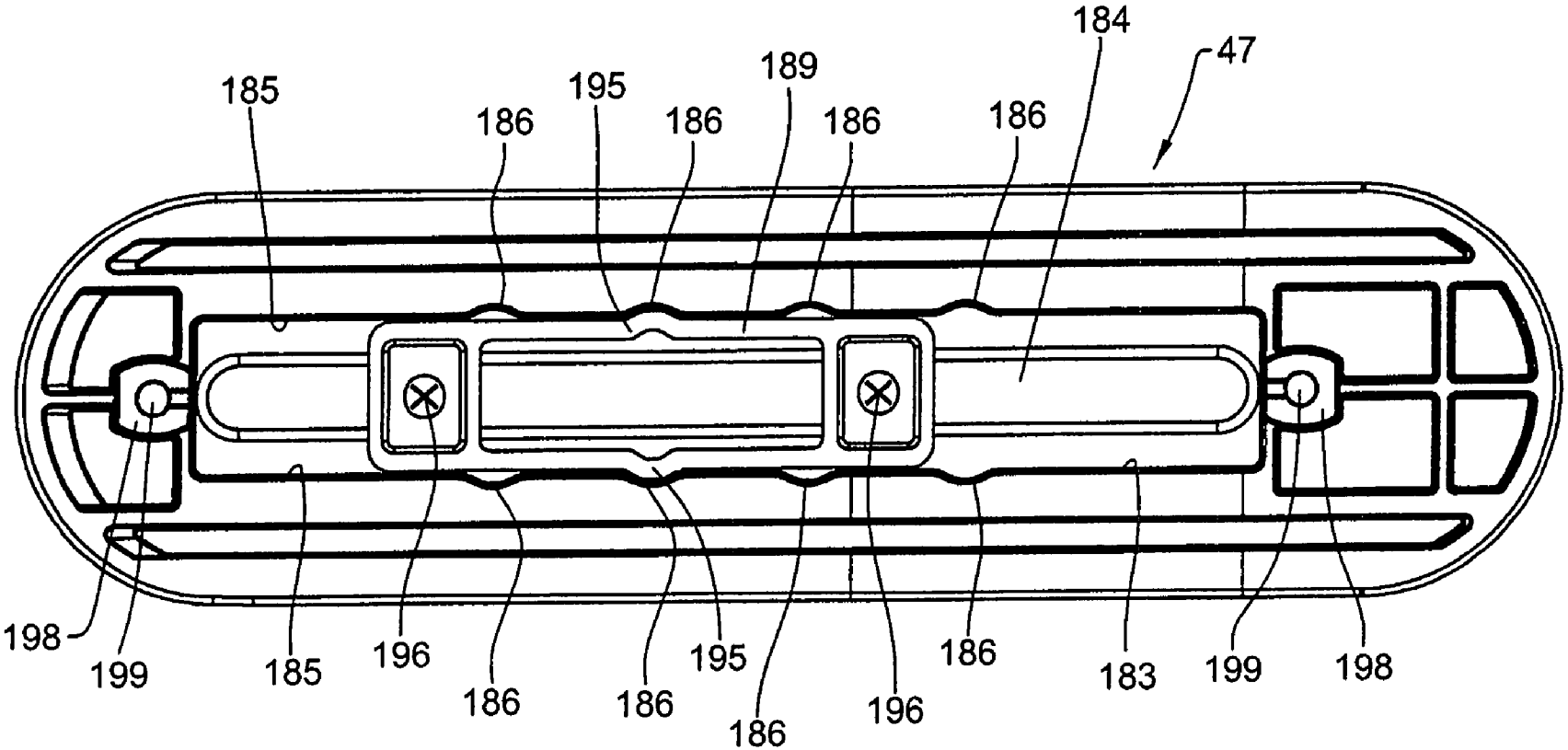
FIG. 35 is a plan view of a slide plate with the cam detent therein.

To facilitate longitudinal sliding of the arm cap 43 in the front-to-back direction, the slide plate 47 is mounted upon the pivot plate 46. Referring to FIGS. 32 and 35, the pivot plate 47 includes a central channel 183 and a longitudinal slot 184 which defines the path along which the slide plate is movable. The channel 183 includes side walls 185 along the longitudinal length thereof which side walls 185 include depressions 186 in longitudinally spaced relation. These recesses 186 define the various stop positions for the arm cap 43 when moved in this longitudinal direction.

The slide plate 47 is positioned onto the pivot plate 46 during assembly, and when so positioned, the central slot 184 receives the projecting post 180 therein along with the upper most section 187 of the pivot shaft 114 as best seen in FIG. 30. The post 180 and shaft section 187 therefore guide longitudinal sliding of the plate 47.

To secure the slide plate 47 in place and also restrain longitudinal movement thereof, the slide detent 189 is fitted into the guide channel 183 as illustrated in FIG. 35. The slide detent 189 (as illustrated in FIG. 32) includes rectangular connector sections 190 at the opposite ends thereof which include bores 191 extending vertically therethrough. These connector sections 190 are joined together by deflectable sidewalls 192 which are separated from each other by a rectangular open space 193 disposed therebetween. The slide detent 189 also is formed of elastomeric material and preferably is formed of urethane. The sidewalls 192 include projecting cams 195 which are configured to engage the channel recesses 186 and the channel sidewalls 185. The slide detent 189 preferably is formed of an acetyl copolymer having some rigidity while also permitting resilient deflection of the sidewalls 192 thereof.

Referring to FIGS. 30 and 35, the slide detent 189 is fitted into the channel 183 with the cams 195 seated within any one of the sidewall recesses 186. The bores 191 are then aligned with the fastener bores 157 and 181 wherein fasteners 196 are then threadedly engaged therewith such that the slide detent 189 remains stationary relative to the pivot plate 46 and secures the intermediate slide plate 47 thereon. Hence, the slide plate 46 is slidable longitudinally relative to the pivot plate 46 to thereby permit longitudinal adjustment of the position of the arm cap 43 relative to the support column 30.

To secure the remaining components to the slide plate 47, this plate 47 also includes raised posts 198 which project upwardly and include vertical fastener bores 199 therein.

Figure 36:
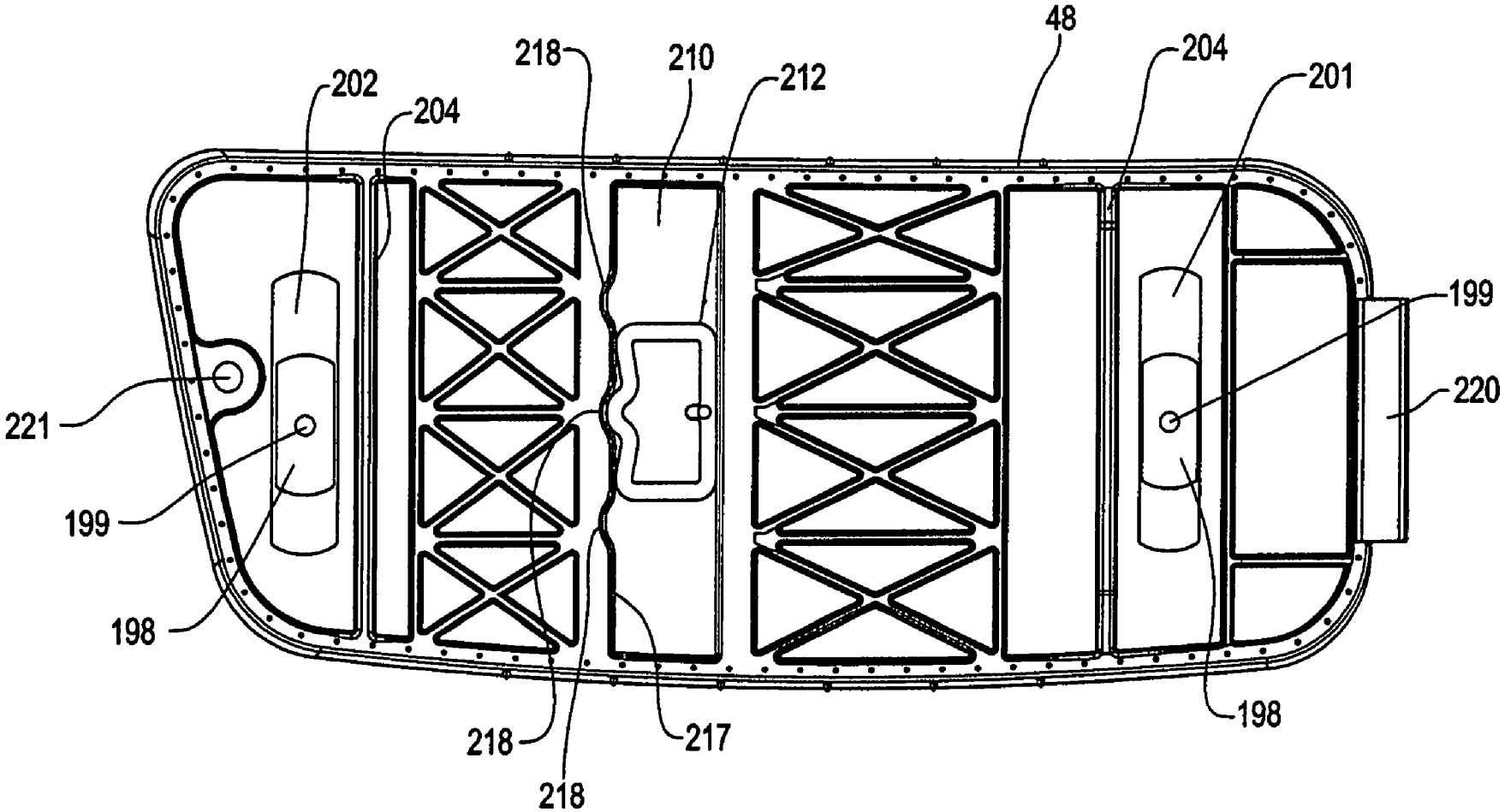
FIG. 36 is a plan view of a subcap plate with the cam detent therein.

Referring to FIGS. 30 and 36, the translatable subcap plate 48 is adapted for mounting to the intermediate slide plate 47. This translatable subcap plate 48 is movable sidewardly or transversely in the direction of reference arrows 162. More particularly, the plate 48 includes transverse guide slots 201 and 202 at the opposite front and rear ends thereof. These guide slots 201 and 202 receive the fastener posts 198 vertically therethrough to thereby govern the transverse sliding of the subcap plate 48. Also, the opposite ends of the slots 201 and 202 define the limits of sideward travel for the arm cap 43. Further, a transverse guide rib 204 is provided adjacent to, and parallel with the guide slots 201 and 202; this will be described in detail in later sections.

More particularly, the retainer plate 49 then mounts on top of the top plate 48 to secure all of the components together. Particularly, the opposite ends of the retainer plate 49 include fastener bores 206 that align with the bores 199 on the post 198 which project through the top plate 48. When the retainer plate 49 is seated onto the top plate 47, fasteners 207 are then threadedly engaged therethrough as illustrated in FIG. 30. This prevents removal of the top plate 47, though top plate 47 is still slidable transversely relative to both the slide plate 47 and the retainer plate 49.

To guide movement of the top plate 48, the retainer plate 49 also includes a guide slot 208 on each end of the bottom thereof into which the corresponding guide ribs 204 are received so that the transverse movement of the subcap plate 48 is essentially perpendicular to the slide plate 47.

To maintain the subcap plate 48 in a selected transverse position, a detent arrangement also is provided between the retainer plate 49 and the stop plate 48. More particularly, the retainer plate 49 on the bottom includes a pair of L-shaped locator ribs 209 which project downwardly and align with a detent cavity 210 formed in the plate 48.

Figure 33:
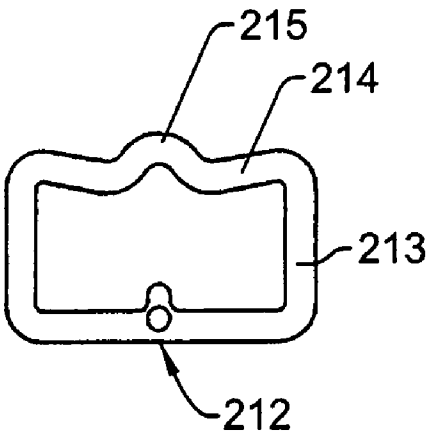
FIG. 33 is a plan view of a cam detent for controlling the transverse width position of the armrest.
Figure 37:
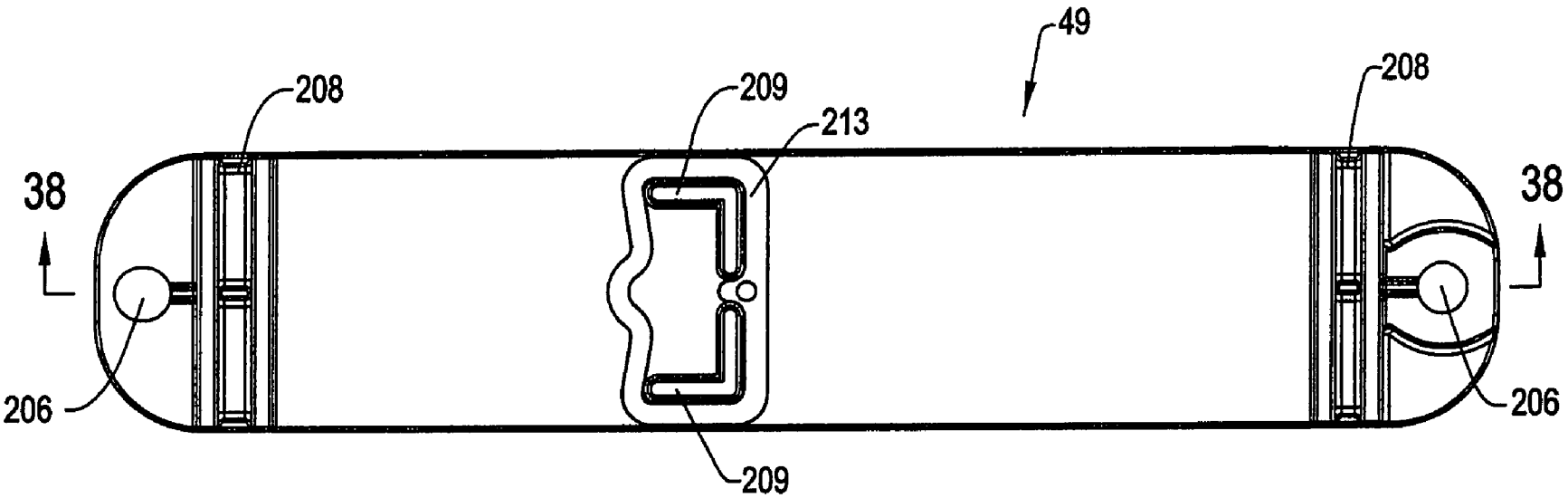
FIG. 37 is a bottom view of a retainer plate with the cam detent supported thereon.
Figure 38:
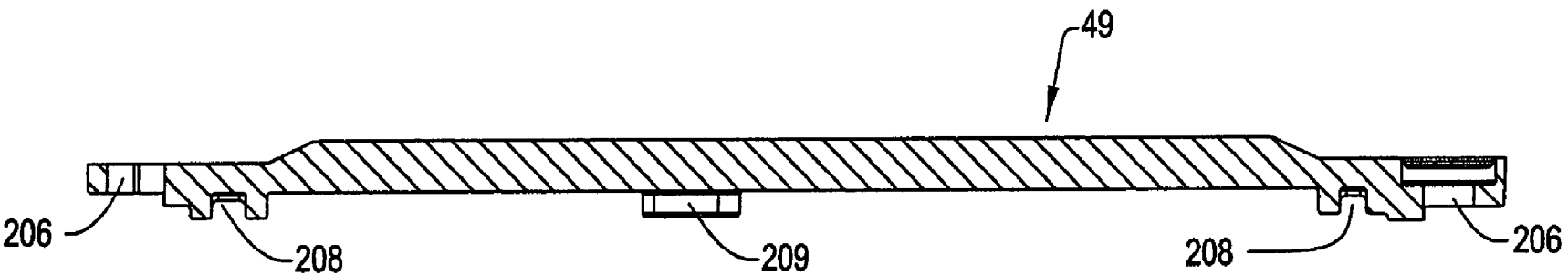
FIG. 38 is a side cross-sectional view of the retainer plate as taken along line 38-38 of FIG. 37.

Referring to FIGS. 36, 37 and 33, this detent arrangement includes a transverse detent 212 which is adapted to fit on the locator ribs 209. More particularly, the transverse detent 212 is formed similar to the above described detents in that it is formed as a ring of elastomeric material, preferably urethane. This detent 212 includes a U-shaped sidewall 213 and a deflectable front wall 214. The front wall 214 further includes an outwardly projecting cam 215. The detent sidewalls 213 are adapted to fit around the locator ribs 209 with the detent front wall 214 extending between the free ends of the locator ribs.

When the retainer plate 49 is mounted in position, this detent 212 fits within the corresponding cavity 210 as illustrated in FIG. 36. The cavity 210 is a shallow depression wherein one sidewall 217 thereof includes a plurality and preferably three depressions 218. When the detent 212 is fitted within this cavity 210, the cam 215 fits into a selected one of these depressions 218 depending on the lateral position of the transverse plate 48 relative to the adjacent plates 47 and 49. This cam 215 fits within a respective depression 218 and maintains the interconnected arm cap 43 in a corresponding lateral position until such time as an adjustment force is applied to the arm cap 43 by an occupant that overcomes the threshold at which the detent front wall 214 then deflects inwardly and permits lateral sliding of the plate 48. Therefore, the detent 212 normally maintains the arm cap 43 in a selected position and resists lateral movement thereof but still permits selected displacement in response to a sufficient adjustment force being applied to the arm cap 43.

The top plate 48 also includes a front hook 220 on the front edge thereof and an additional fastener bore 221 (FIG. 36) which receives a fastener 222 (FIG. 30) to secure the arm cap 43 in place onto the subcap plate 48.

In view of the foregoing, assembly of the arm cap assembly 35 is accomplished by first positioning the pivot plate 46 onto the shaft 114, locating the bearing 166 in the appropriate slot 164 and then fastening the bearing 166 in place by the fastener 169. The plate 46 thereby is non-removably connected by the support column 40.

Thereafter, the intermediate slide plate 47 is positioned with its respective center slot 184 aligned with and receiving the upwardly projecting post 180 and shaft projection 157 therethrough. Then the slide detent 189 is positioned with the fastener holes 191 thereof aligned with the respective fastener bores 157 and 181 so that the fasteners 196 may be secured with these bores. As such, the intermediate slide plate 47 is non-removably fixed to the pivot plate 46 but is still slidable relative thereto in the direction of reference arrow 161.

Then, the translatable top plate 48 is positioned onto the slide plate 47 with the post 198 projecting through the slots 201 and 202. The retainer plate 49 is assembled with the detent 212 located on the bottom thereof and then positioned over the plate 48. The guide slots 208 and the retainer plate 49 are fitted onto the upstanding guide ribs 204 which therefore aligns the bores 206 on the retainer plate 49 with the corresponding fastener bores 199 located on the post 198. Fasteners 207 are screwed into place which prevents removal of the top plate 48 from the lower slide plate 47 while still permitting transverse sliding movement thereof.

Finally, the top cap is hooked onto the front hook 220 and secured in place to complete the assembly of the arm cap arrangement. Once the full arm rest assembly 35 is assembled together, it is installed by inserting the support column 40 downwardly into the support tube 36.

With the foregoing arrangement, the arm cap 43 may be readily adjusted with respect to any of its elevation, angular position, longitudinal position and transverse position.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An armrest assembly comprising:

a support post having a fixed hub thereon defining a substantially vertical pivot axis;

a pivot plate which is pivotally connected to said hub so as to angularly pivot about said substantially vertical pivot axis, said pivot plate having a first fastener engaged with said support post preventing removal of said pivot plate from said hub;

a first intermediate slide plate slidably connected to said pivot plate so as to move along a first longitudinal path, said intermediate slide plate including a second fastener engaged with said support post and a third fastener engaged with said pivot plate which prevent removal of said intermediate slide plate from said support post and from said pivot plate;

a second slide plate slidably fixed to said first slide plate so as to be slidable along a second longitudinal path oriented transverse to said first longitudinal path, said second slide plate having a fourth fastener engaged with said intermediate slide plate and preventing removal of said second slide plate from said intermediate slide plate that is connected to said pivot plate and said support post; and an armrest mounted to said second slide plate for supporting an arm of a user.

2. The armrest assembly according to claim 1, wherein a detent arrangement is provided between at least one of said pivot plate and said intermediate slide plate, and said intermediate slide plate and said second slide plate.

3. The armrest assembly according to claim 2, wherein said pivot plate defines an angular position for said armrest.

4. The armrest assembly according to claim 2, wherein said intermediate slide plate defines a longitudinal position of said armrest in a front-to-back direction.

5. The armrest assembly according to claim 2, wherein said second slide plate defines a longitudinal position of the armrest in a side-to-side direction.

6. The armrest assembly according to claim 1, wherein first, second and third detent arrangements are respectively provided between said pivot plate and said support post, said intermediate slide plate and said pivot plate, said second slide plate and said intermediate slide plate, said first, second and third detent arrangements respectively restraining said pivot plate relative to said support post in a desired angular position, said intermediate slide plate relative to said pivot plate in a desired first longitudinal position along said first longitudinal path, and said second slide plate relative to said intermediate slide plate in a desired second longitudinal position along said second longitudinal path.

7. The armrest assembly according to claim 6, wherein said pivot plate angularly locates said armrest in said angular position, said first slide plate locates said armrest in said first longitudinal position along said first longitudinal path which extends in a front-to-back direction, and said second slide plate locates said armrest in said second longitudinal position along said second longitudinal path which extends in a side-to-side direction.

8. The armrest assembly according to claim 6, wherein said first detent arrangement includes a stationary pivot bearing, which cooperates with said pivot plate to define said angular position, and further includes said first fastener, which secures said pivot bearing to said support post and prevents removal of said pivot plate from said support post while permitting said angular pivoting thereof.

9. The armrest assembly according to claim 6, wherein said second detent arrangement comprises a slide detent which slidably cooperates with said intermediate slide plate to define said first longitudinal position, and further includes said second and third fasteners which secure said intermediate slide plate to said support post and said pivot plate.

10. The armrest assembly according to claim 6, wherein said third detent arrangement comprises a retainer plate which slidably cooperates with said second slide plate to define said second longitudinal position, and further includes said fourth fastener which secures said second slide plate to said intermediate slide plate.

11. An armrest assembly comprising:

a support post having a hub thereon which defines a substantially vertical pivot axis;

a pivot plate which is pivotally connected to said hub so as to angularly pivot about a substantially vertical pivot axis;

a first detent arrangement provided between said pivot plate and said support post to selectively restrain said pivot plate relative to said support post in a desired angular position, said first detent arrangement preventing removal of said pivot plate from said support post while permitting said angular pivoting thereof;

an intermediate slide plate slidably connected to said pivot plate so as to be longitudinally slidable along a first longitudinal path;

a second detent arrangement connected between said intermediate pivot plate and said pivot plate to selectively restrain said intermediate slide plate relative to said pivot plate in a desired first longitudinal position along said first longitudinal path, said second detent arrangement securing said intermediate slide plate to said pivot plate while permitting said longitudinal sliding of said intermediate slide plate;

a second slide plate slidably fixed to said intermediate slide plate so as to be longitudinally slidable along a second longitudinal path oriented transverse to said first longitudinal path;

a third detent arrangement connected between said second slide plate and said intermediate slide plate to selectively restrain said second slide plate relative to said intermediate slide plate in a desired second longitudinal position along said second longitudinal path, said third detent arrangement securing said second slide plate to said intermediate slide plate while permitting said longitudinal sliding of said second slide plate; and an armrest mounted to said second slide plate for supporting an arm of a user.

12. The armrest assembly according to claim 11, wherein said pivot plate angularly locates said armrest in said angular position, said first slide plate locates said armrest in said first longitudinal position along said first longitudinal path which extends in a front-to-back direction, and said second slide plate locates said armrest in said second longitudinal position along said second longitudinal path which extends in a side-to-side direction.

13. The armrest assembly according to claim 11, wherein said first detent arrangement includes a stationary pivot bearing, which cooperates with said pivot plate to define said angular position, and further includes a first fastener, which secures said pivot bearing to said support post and prevents removal of said pivot plate while permitting said angular pivoting thereof.

14. The armrest assembly according to claim 11, wherein said second detent arrangement comprises a slide detent which slidably cooperates with said intermediate slide plate to define said first longitudinal position, and further includes second and third fasteners which respectively secure said intermediate slide plate to said support post and said pivot plate.

15. The armrest assembly according to claim 11, wherein said third detent arrangement comprises a retainer plate which slidably cooperates with said second slide plate to define said second longitudinal position, and further includes at least a fourth fastener which secures said second slide plate to said intermediate slide plate.

16. The armrest assembly according to claim 11, wherein said first detent arrangement includes a stationary pivot bearing, which cooperates with said pivot plate to define said angular position, and further includes a first fastener, which secures said pivot bearing to said support post and prevents removal of said pivot plate while permitting said angular pivoting thereof, said second detent arrangement comprises a slide detent which slidably cooperates with said intermediate slide plate to define said first longitudinal position, and further includes second and third fasteners which respectively secure said intermediate slide plate to said support post and said pivot plate, and said third detent arrangement comprises a retainer plate which slidably cooperates with said second slide plate to define said second longitudinal position, and further includes at least a fourth fastener which secures said second slide plate to said intermediate slide plate.

17. The armrest assembly according to claim 16, wherein said pivot bearing remains stationary relative to said support post and said pivot plate moves relative to said pivot bearing during angular pivoting of said pivot plate, wherein said slide detent remains stationary relative to said pivot plate and said intermediate slide plate moves relative to said slide detent during longitudinal sliding thereof, and wherein said retainer plate remains stationary relative to said intermediate slide plate, and said second slide plate moves relative to said retainer plate during longitudinal sliding thereof.

* * * * *